US006579023B2

(12) United States Patent
Kunkler et al.

(10) Patent No.: US 6,579,023 B2
(45) Date of Patent: Jun. 17, 2003

(54) CLEANING IMPLEMENTS

(75) Inventors: Jeffery Scott Kunkler, Simi Valley, CA (US); Christopher Todd Boyer, Oak Park, IL (US); Kevin James Zwart, Chicago, IL (US); Arnold George Benecke, Indian Springs, OH (US); Roderick Edward Kleiss, Shoreview, MN (US); Kevin Michael Campbell, Chicago, IL (US); Paul Michael Lesley, Chicago, IL (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/865,823

(22) Filed: May 25, 2001

(65) Prior Publication Data

US 2001/0046407 A1 Nov. 29, 2001

Related U.S. Application Data

(63) Continuation of application No. PCT/US00/26384, filed on Sep. 26, 2000, now abandoned.

(60) Provisional application No. 60/199,444, filed on Apr. 25, 2000, provisional application No. 60/156,289, filed on Sep. 27, 1999, and provisional application No. 60/156,286, filed on Sep. 27, 1999.

(51) Int. Cl.[7] ..... A47L 1/08

(52) U.S. Cl. ..... 401/138; 401/140; 401/139

(58) Field of Search ..... 401/138, 137, 401/139, 140, 270, 282; 15/98, 231, 228, 50.1, 320, 321

(56) References Cited

U.S. PATENT DOCUMENTS 4,146,944 A * 4/1979 Pinto ..... 15/321
5,392,490 A * 2/1995 Monson ..... 15/320
5,964,003 A * 10/1999 Rogers ..... 15/98

* cited by examiner

*Primary Examiner*—David J. Walczak
(74) *Attorney, Agent, or Firm*—Thibault Fayette; Kim William Zerby; Steven W. Miller

(57) ABSTRACT

A cleaning implement includes a liquid delivery system for providing a cleaning liquid to a surface to be cleaned having a canister for storing a liquid, an electrical motor driving a pump, and a voltage source for engerizing the electric motor. A support head is pivotally attached to the handle for releasably receiving a cleaning sheet. The handle includes a switch and is formed from a plurality of handle sections. Each handle section has at least one electrical connector which is electrically connected with an electrical connector of an adjacent handle section so that the switch can activate the electrical motor. The support head can be configured to allow visual inspection of the cleaning sheet through the support head during use. The canister is provided with plurality of side walls and vent valve having a cracking pressure of at least about 0.6 Kpa, wherein the canister is substantially in the form of a parallelogram in a plan view cross section and wherein one or more of the side walls has a plurality of grooves.

17 Claims, 26 Drawing Sheets

CLEANING IMPLEMENTS

This is a continuation of International Application PCT/US00/26384, with an international filing date of Sep. 26, 2000, published in English under POT Article 21(2) and now abandon, which claims the benefit of U.S. Provisional Application Nos. 60/156,286, filed on Sep. 27, 1999, 60/156,289, filed on Sep. 27, 1999 and 60/199,444, filed on Apr. 25, 2000.

CROSS-REFERENCE TO RELATED APPLICATIONS AND PATENTS

This application is related to the following applications and patents, each of which is hereby incorporated by reference herein: U.S. application Ser. No. 09/188,604 filed Nov. 9, 1998 by Nagel et al.; U.S. application Ser. No. 09/201,618 filed Nov. 30, 1998 by Benecke; U.S. Provisional Application Ser. No. 60/110,476 filed Dec. 1, 1998 by Policicchio et al.; U.S. Provisional Application Ser. No. 60/162,935 filed Nov. 2, 1999 by Policicchio et al.; U.S. application Ser. No. 09/381,550 filed Mar. 16, 1998 by Policicchio et al.; U.S. Pat. No. 5,960,508 issued Oct. 5, 1999 to S. A. Holt et al.; U.S. Pat. No. 6,003,191 issued Dec. 21, 1999 to A. E Sherry et al.; U.S. patent application Ser. No. 08/756,999 filed Nov. 26, 1996 by S. A. Holt et al.; PCT Application No. US99/10971 filed May 18, 1999; PCT Application No. US99/27893 filed Nov. 24, 1999; U.S. Provisional Application Serial No. 60/129,949 filed Apr. 19, 1999 by R. A. Godfroid et al.; and U.S. application Serial No. 09/037,379 filed Mar. 10, 1998 by Policicchio et al.

TECHNICAL FIELD

The present invention relates to the field of cleaning implements, and, more particularly, to the field of electrically operated mops for spraying cleaning liquids onto a floor.

BACKGROUND OF THE INVENTION

The literature is replete with products capable of cleaning hard surfaces such as ceramic tile floors, hardwood floors, counter tops and the like. In the context of cleaning floors, numerous devices are described comprising a handle and some means for absorbing a fluid cleaning composition. Such devices include those that are reusable, including mops containing cotton strings, cellulose and/or synthetic strips, sponges, and the like. While these mops are successful in removing many soils from hard surfaces, they typically require the inconvenience of performing one or more rinsing steps during use to avoid saturation of the material with dirt, soil, and other residues. These mops therefore require the use of a separate container to perform the rinsing step(s), and typically these rinsing steps fail to sufficiently remove dirt residues. This can result in redeposition of significant amounts of soil during subsequent passes of the mop. Furthermore, as reusable mops are used over time, they become increasingly soiled and malodorous. This negatively impacts subsequent cleaning performance.

While there is a desire to provide mops which are convenient and adept at soil removal, there is a further need to provide these mops in a form which is easy to ship and assemble by a consumer. Still further, there is a desire to provide cleaning mops which facilitate proper assembly by a consumer and which are ergonomic and easy to use.

SUMMARY OF THE INVENTION

A cleaning implement is provided. The cleaning implement includes a liquid delivery system for providing a cleaning liquid to a surface to be cleaned having a canister for storing a liquid, an electrical motor driving a pump, and a voltage source for engerizing the electric motor. A support head is pivotally attached to the handle for releasably receiving a cleaning sheet. The handle includes a switch and is formed from a plurality of handle sections. Each handle section has at least one electrical connector which is electrically connected with an electrical connector of an adjacent handle section so that the switch can activate the electrical motor. The support head can be configured to allow visual inspection of the cleaning sheet through the support head during use. The canister is provided with plurality of side walls and vent valve having a cracking pressure of at least about 0.4 Kpa, wherein the canister is substantially in the form of a parallelogram in a plan view cross section and wherein one or more of the side walls have a plurality of grooves.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENTS

Figure 1:
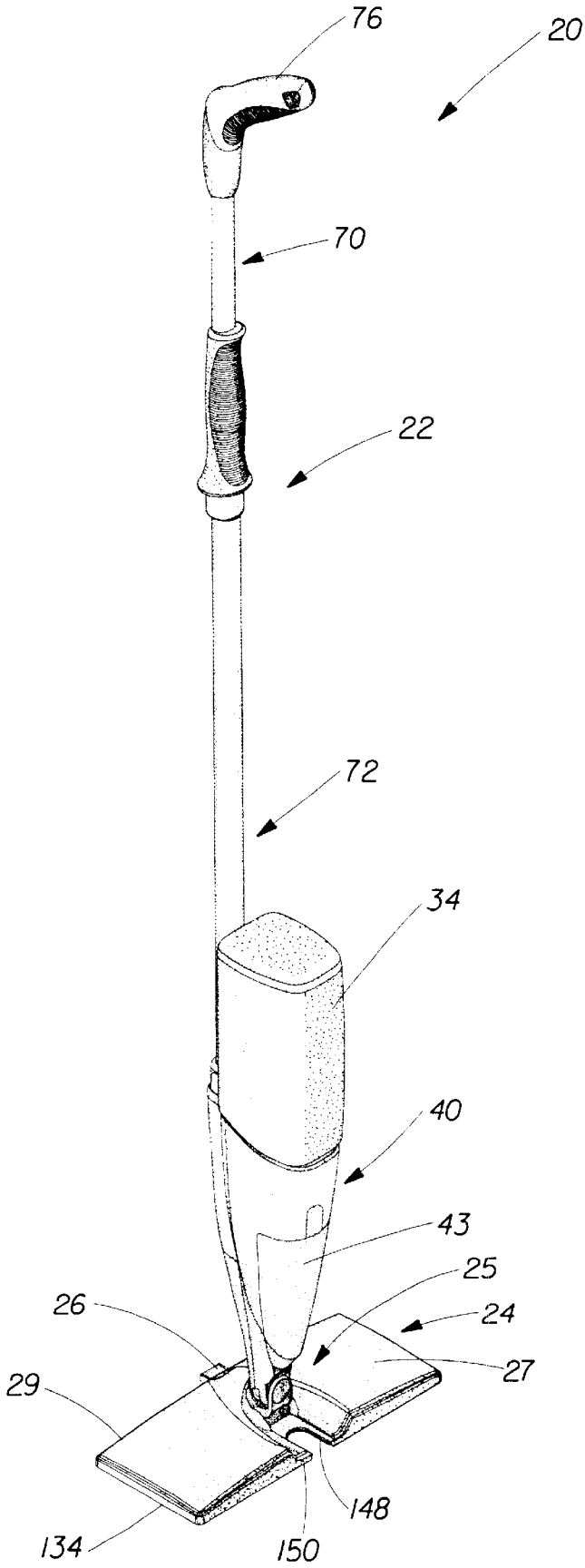
FIG. 1 is a perspective view of a preferred floor mop made in accordance with the present invention.

Reference will now be made in detail to the present preferred embodiments of the invention, examples of which are illustrated in the accompanying drawings wherein like numerals indicate the same elements throughout the views. As described more fully hereafter, the present invention is directed to cleaning implements for use with hard surfaces such as floors, and the like. The cleaning implement is used in combination with a liquid cleaning composition (although other liquid compositions, such as waxes, etc., can be used with cleaning implements of the present invention) and a cleaning substrate, such as a removable pad or sheet, for absorbing and removing the cleaning composition and particulates (e.g., dirt, soil, dust, etc.) from the hard surface.

Preferred liquid cleaning compositions, examples of which are described in greater detail in U.S. Provisional Application Serial No. 60/156,286 filed Sep. 27, 1999 by Sherry et al. and U.S. Provisional Application Serial No. 60/162,935 filed Nov. 2, 1999 by Policicchio et al., can comprise:

(a) optionally, from about 0.001% to about 0.5% by weight of the composition of surfactant, preferably selected from the group consisting of alkylpolysaccharides, alkyl ethoxylates, alkyl sulfonates, and mixtures thereof;

(b) optionally, hydrophilic polymer, preferably less than about 0.5% by weight of the composition;

(c) optionally, organic solvent, preferably from about 0.25% to about 7% by weight of the composition and preferably having a boiling point of from about 120° C. to about 180° C.;

(d) optionally, from about 0.01% to about 1% by weight of the composition of mono- or polycarboxylic acid;

(e) optionally, from about 0.01% to about 1% by weight of the composition of odor control agent, preferably cyclodextrin;

(f) optionally, a source of peroxide, preferably from about 0.05% to about 5% by weight of the composition and preferably selected from the group consisting of benzoyl peroxide, hydrogen peroxide, and mixtures thereof;

(g) optionally, from about 0.001% to about 0.1% by weight of the composition of thickening polymer;

(h) aqueous solvent system, preferably at least about 80% by weight of the composition;

(i) optionally, suds suppressor;

(j) optionally, from about 0.005% to about 0.2% by weight of the composition of a perfume comprising:

(i) optionally, from about 0.05% to about 90% by weight of the perfume of volatile, hydrophilic perfume material;

(ii) optionally, at least about 0.2% by weight of the perfume of volatile, hydrophobic perfume material;

(iii) optionally, less than about 10% by weight of the perfume of residual, hydrophilic perfume material;

(iv) less than about 10% by weight of the perfume of residual, hydrophobic perfume material;

(k) optionally, a detergent adjuvant, preferably selected from the group consisting of detergency builder, buffer, preservative, antibacterial agent, colorant, bleaching agents, chelants, enzymes, hydrotropes, and mixtures thereof.

The cleaning implement is also used in combination with a cleaning substrate, such as a sheet, a premoistened wipe, or other woven or non-woven fabric, examples of which are also described in greater detail in U.S. Provisional Application Serial No. 60/162,935 filed Nov. 2, 1999 by Policicchio et al. and U.S. Pat. No. 5,960,508 issued Oct. 5, 1999 to S. A. Holt et al., to remove the liquid cleaning composition and particulates from the hard surface. A preferred cleaning substrate suitable for use with the present invention can comprise:

(a) at least one absorbent layer;

(b) optionally, a liquid pervious scrubbing layer; wherein the liquid pervious scrubbing layer is preferably an apertured formed film, more preferably a macroscopically expanded three-dimensional plastic web, having tapered or funnel-shaped apertures and/or surface aberrations and preferably comprising a hydrophobic material;

(c) optionally, an attachment layer, wherein the attachment layer preferably comprises a clear or translucent material, more preferably a clear or translucent polyethylene film, and wherein the attachment layer preferably comprises loop and/or hook material for attachment to a support head of a handle of a cleaning implement;

(d) optionally, multiple planar surfaces;

(e) optionally, at least one functional cuff, preferably at least one free-floating, looped functional cuff;

(f) optionally, a density gradient throughout at least one absorbent layer; wherein the density gradient preferably comprises a first absorbent layer having a density of from about 0.01 g/cm$^3$ to about 0.15 g/cm$^3$, preferably from about 0.03 g/cm$^3$ to about 0.1 g/cm$^3$, and more preferably from about 0.04 g/cm$^3$ to about 0.06 g/cm$^3$, and a second absorbent layer having a density of from about 0.04 g/cm$^3$ to about 0.2 g/cm$^3$, preferably from about 0.1 g/cm$^3$ to about 0.2 g/cm$^3$, and more preferably from about 0.12 g/cm$^3$ to about 0.17 g/cm$^3$; wherein the density of the first absorbent layer is about 0.04 g/cm$^3$, preferably about 0.07 g/cm$^3$, and more preferably about 0.1 g/cm$^3$, less than the density of the second absorbent layer;

(g) optionally, at least one adhesive scrubbing strip, preferably comprising a material selected from the group consisting of nylon, polyester, polypropylene, abrasive material, and mixtures thereof; and (h) optionally, perfume carrier complex, preferably selected from the group consisting of cyclodextrin inclusion complex, matrix perfume microcapsules, and mixtures thereof; wherein the perfume carrier complex is preferably located in an absorbent layer.

The various layers and/or elements can be bonded in a variety of ways including, but not limited to, adhesive bonding, thermal bonding, ultra sonic bonding, and the like. The various layers and/or elements can be assembled to form a cleaning pad either by hand or by a conventional line converting process known in the art. While these are examples of preferred liquid cleaning compositions and cleaning substrates, it will be appreciated that the present invention can be used with other cleaning compositions and substrates without departing from scope of the invention.

Figure 2:
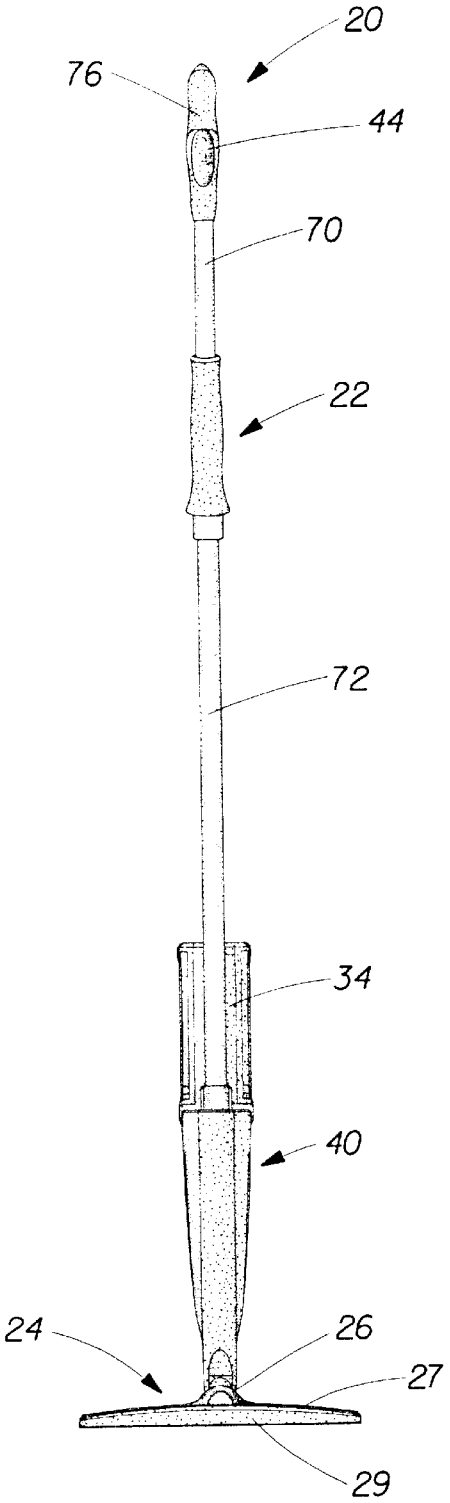
FIG. 2 is front elevational view of the floor mop of FIG. 1.
Figure 3:
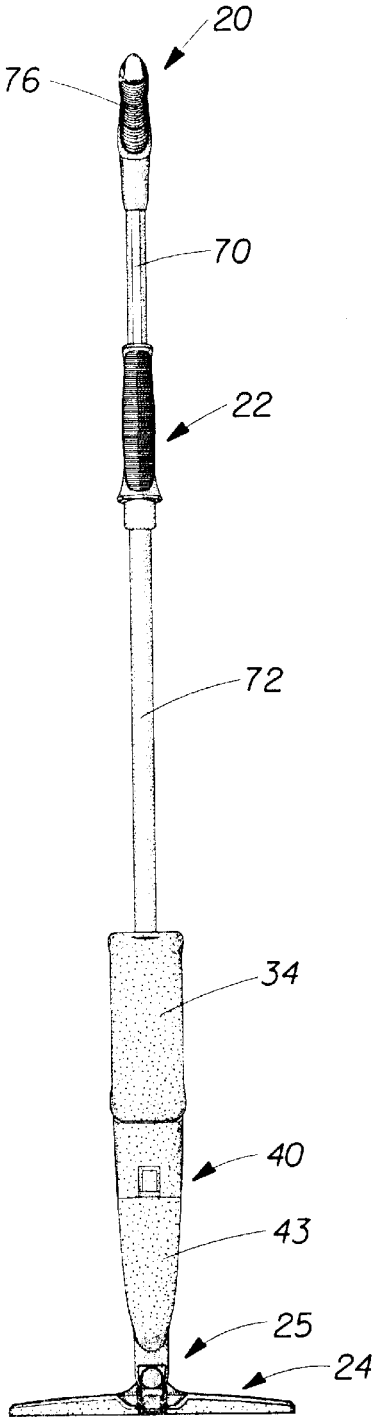
FIG. 3 is a rear elevational view of the floor mop of FIG. 1.

Referring to FIGS. 1, 2, and 3, an exemplary cleaning implement made in accordance with the present invention and in the form of a floor mop 20 is illustrated. The floor mop 20 comprises a handle 22 formed from a plurality of sections, a mop head 24 attached to the handle by a universal joint 25, and a liquid delivery system which includes a spray nozzle 26 attached to the upper plate 27 of the mop head 24 adjacent to its leading edge 29 such that the spray nozzle 26 can move in the direction of the mop head 24 when the mop 20 is maneuvered. While the spray nozzle 26 is preferably attached independent of the handle 22 for directional control of the spray nozzle 26, it will be appreciated that the spray nozzle can be attached at locations other than the mop head 24. For example, the spray nozzle 26 can be attached to the universal joint 25 or the handle 22.

Figure 4:
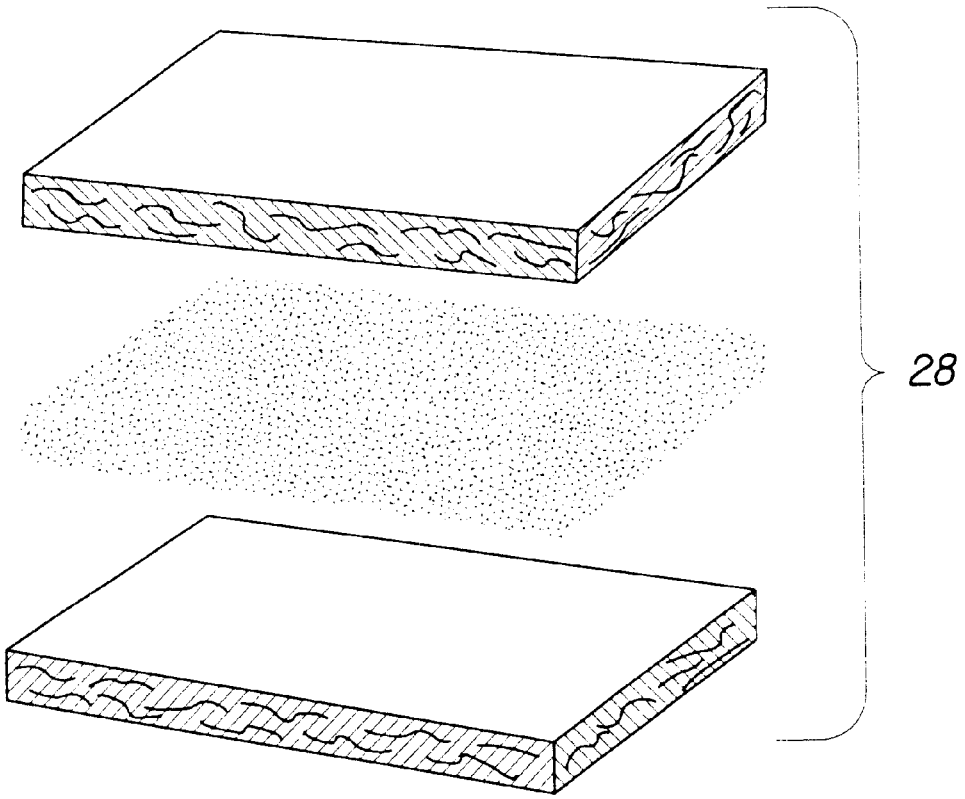
FIG. 4 is an exploded view of an exemplary cleaning sheet suitable for use with the floor mop of FIG. 1.

As previously discussed, the cleaning implements of the present invention use a removeably attached cleaning substrate 28, such as the tri-layer cleaning substrate illustrated in FIG. 4, for absorbing the cleaning liquid and particulates from the surface to be cleaned. The cleaning substrate 28 can be mechanically attached in a variety ways to mop head 24. For example, adhesives, snaps, hook and loop fasteners, etc. can be used. Alternatively, attachment structures such as those described in U.S. patent application Ser. No. 09/374,714 entitled CLEANING IMPLEMENTS HAVING STRUCTURES FOR RETAINING A SHEET, filed Aug. 13, 1999, the substance of which is fully incorporated herein by reference, can be incorporated onto the upper surface of the mop head 24.

Figure 5:
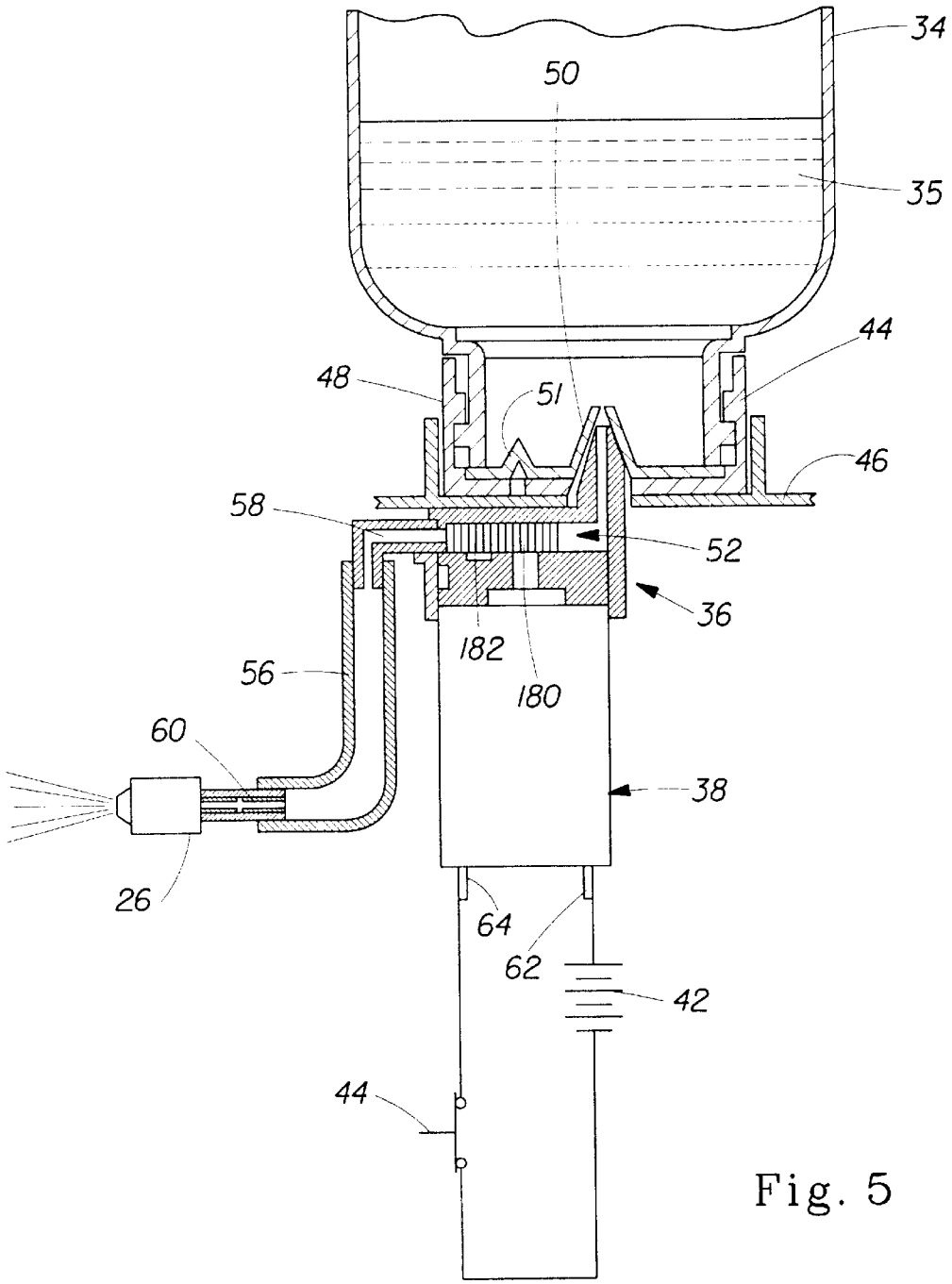
FIG. 5 is a schematic illustration of a liquid delivery system suitable for use with the floor mop of FIG. 1.
Figure 10:
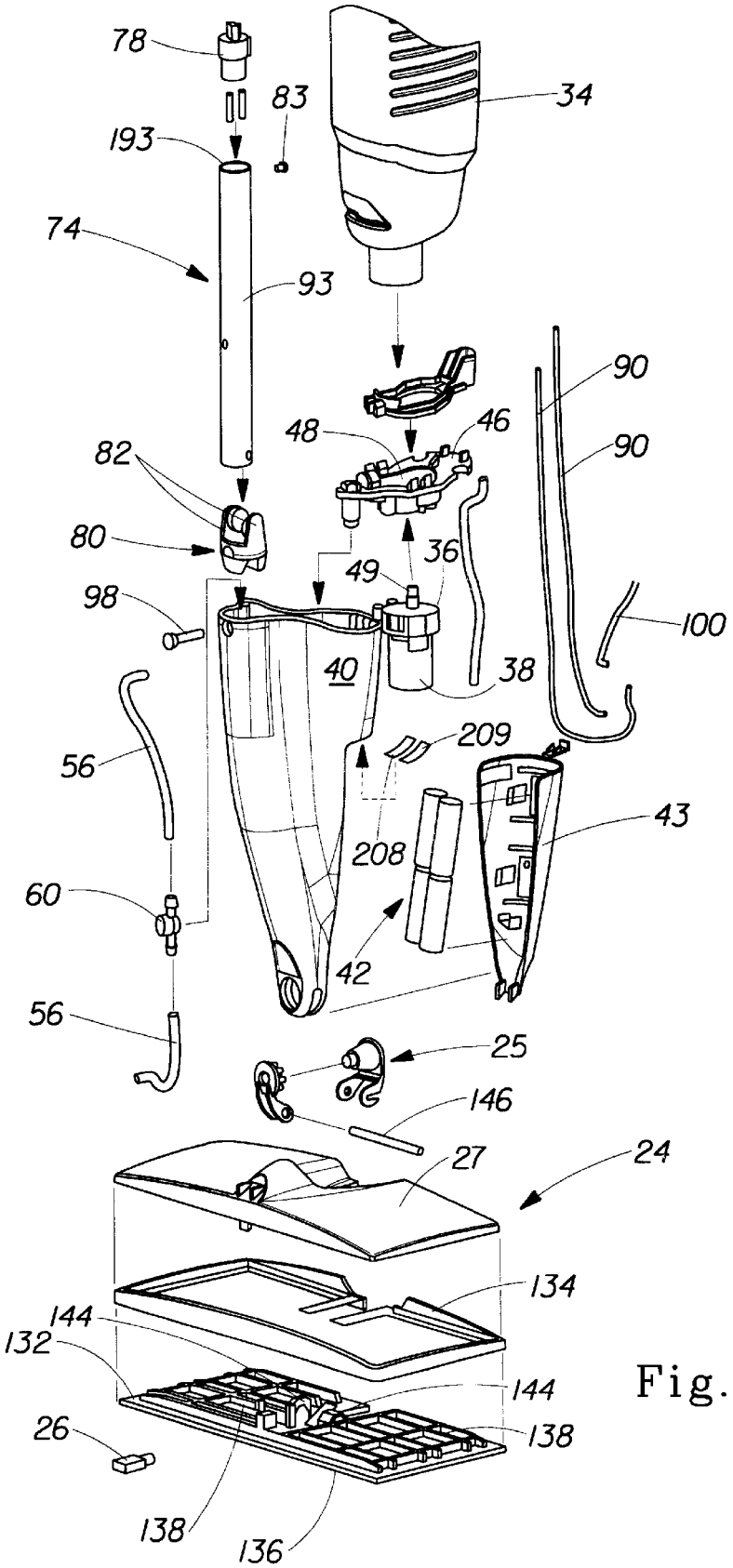
FIG. 10 is an exploded view of the third handle section, canister housing, and mop head of the floor mop of FIG. 1.

Referring to schematic FIG. 5 and FIG. 10 for ease of discussion, the liquid delivery system further includes a canister 34 storing the liquid cleaning composition 35 and a gear pump 36 which is driven by an electric motor 38. A canister housing 40 attached to the handle 22 removeably receives the canister 34. The canister housing 40 houses the gear pump 36, the electric motor 38, and a voltage source 42 which is used to power the electric motor 38. The voltage source 42 is preferably a plurality of batteries which are stored in a battery cradle 43, wherein the battery cradle 43 forms part of the canister housing 40. The voltage source 42 is connected in series with a switch 44 attached to the handle 22. While the pump 36 is preferably provided in the form of a gear pump, other pumps and structures for pressurizing the liquid 35 to deliver the liquid to the spray nozzle 26 can be used. For example, vane, piston, lobe, or diaphragm pumps would be acceptable for use. In addition, aerosols and other compressed gas delivery systems can be used in place of an electric or manually driven pump. The gear pump 36 is attached to a mounting plate 46 disposed within the canister housing 40. The mounting plate 46 also has a recessed portion 48 for receiving the canister 34. The gear pump has a probe 49 attached to the top thereof which interfaces with the canister 34 to transfer the liquid cleaning composition 35 from the canister 34 to the inlet 52 of the gear pump 36. The canister 34 includes a venting check valve 51 for venting the canister 34 during use and a liquid transfer check valve 53 through which the probe 49 passes for transferring the liquid cleaning composition from the canister 34 to the gear pump 36.

A flexible fluid line 56 is connected to the pump outlet 58, which directs the liquid cleaning composition 35 from the pump outlet 58 to the spray nozzle 26. A discharge check valve 60 is located upstream of the spray nozzle 26. The check valve 60 may be a spring loaded ball valve or other type of check valve commonly known in the art, such as a membrane valve. The purpose of the check valve 60 is to limit dribbling of liquid cleaning composition 35 from the spray nozzle 26. The cracking pressure of the check valve 60 should be sufficient so that the liquid entering the spray nozzle 26 has sufficient energy to drive the fluid through the spray nozzle 26 and break the fluid up into fine droplets.

The electric motor 38 is preferably a direct current electric motor. The electric motor 38 has two electrical connections 62 and 64 to which is preferably connected the voltage source 42, which can be provided in the form of a plurality of batteries. When the switch 44 is closed, as shown in FIG. 5, a current flows through the electric motor 38 which rotates the gears of the pump 36 to generate a pressure sufficient to open the check valve 60 so that the liquid 35 can flow through the spray nozzle 26. An exemplary motor is a 3 volt to 6 volt series 200 or 300 motor manufactured by Mabuchi Industry Company, Ltd. of China while an exemplary spray nozzle is manufactured by Bowles Fluidics Corporation of Columbia, Mo. This exemplary spray nozzle is more fully described in one or more of U.S. Pat. No. 4,508,206 to Stouffer, issued Apr. 2, 1985; U.S. Pat. No. 5,788,394 to Hess et al., issued Aug. 4, 1998; and U.S. Pat. No. 5,860,603 to Raghu et al., issued Jan. 19, 1999, the substances of which are fully incorporated herein by reference. The handle 22, canister housing 37, mop head 24, universal joint 25, and pump gears can be injection molded using thermoplastic materials as is known in the art. Preferably, the canister housing 37 and mop head 24 are formed from polypropylene, the universal joint 25 and the pump gears are preferably formed from an acetal polymer. The handle 22 can be formed from aluminum by extrusion. The voltage source 39 is preferably four AA, 1.5 volt Panasonic Alkaline Plus batteries which are connected in series.

Figure 6:
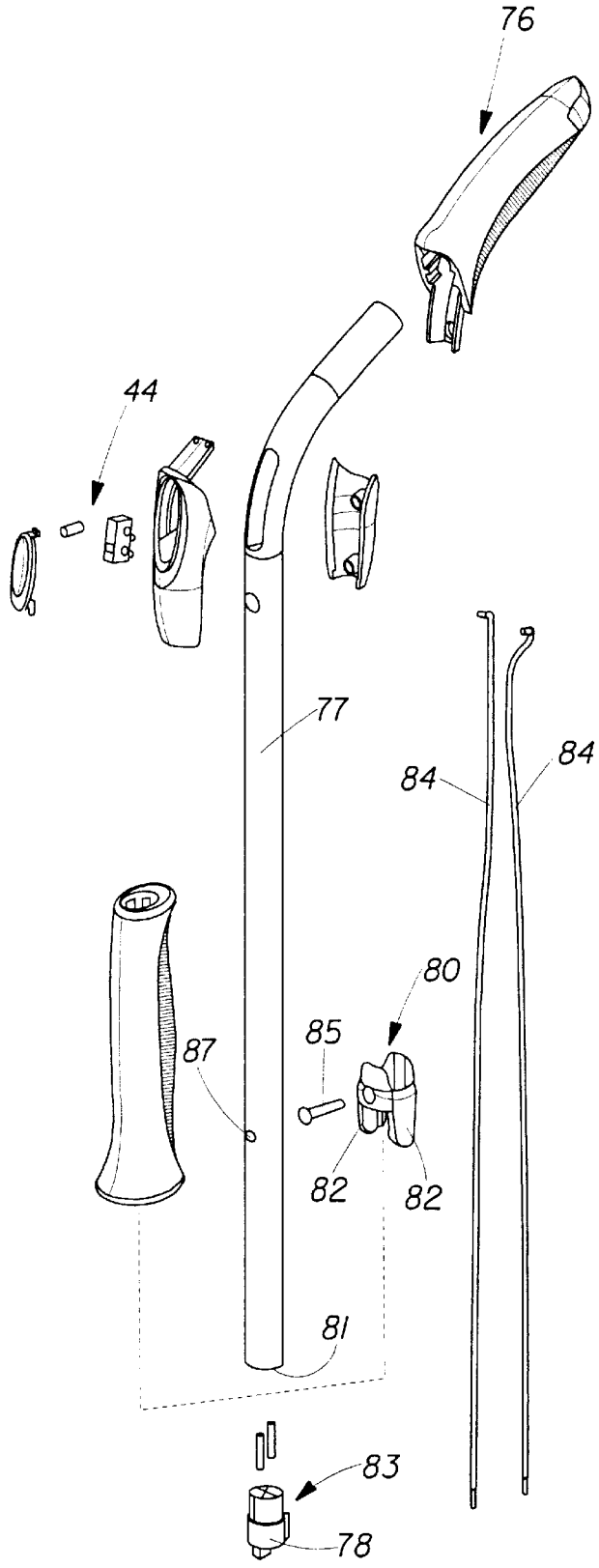
FIG. 6 is an exploded view of the first handle section of the floor mop of FIG. 1.
Figure 7:
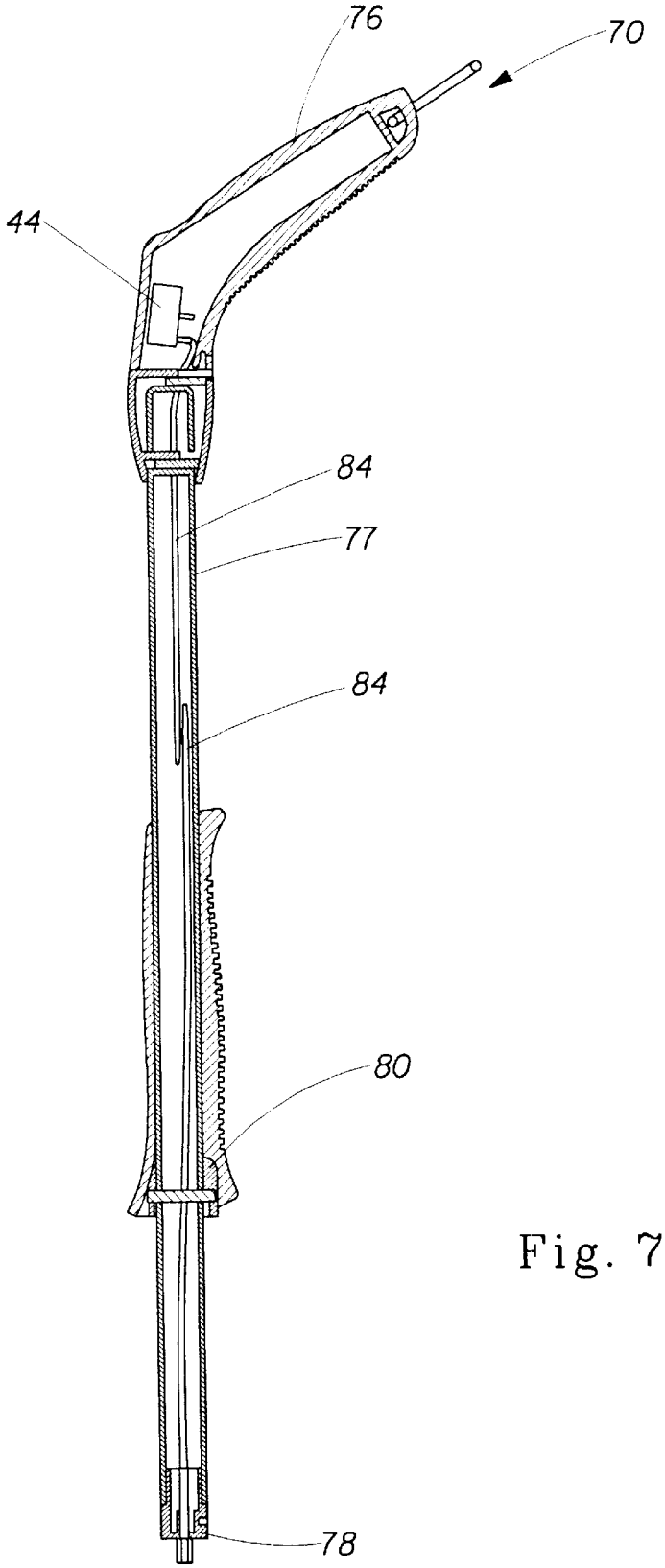
FIG. 7 is a cross-sectional side view of the first handle section of the floor mop of FIG. 1.

In accordance with one aspect of the present invention, the handle 22 preferably comprises three handle sections 70, 72, and 74 which are interconnected to form the handle 22. As seen in FIGS. 6 and 7, the upper or first handle section 70 includes a handle grip 76 attached to a tube 77, the switch 44 mounted in the handle grip 76, an external electrical connector 78, and a locking connector 80 having prongs 82. The external electrical connector 78 is connected to the tube 77 by a screw 83. Two electrical wires 84 disposed within the tube 77 interconnect the switch 44 with the external electrical connector 78, these wires being each only partially visible in FIG. 6 for clarity. The locking connector 80 is preferably offset a distance from the end 81 of the first handle section 70. More preferably, the locking connector 80 is disposed at least about 20 mm from the end 81 of the first handle section 70. Most preferably, the locking connector 80 is disposed between about 20 mm and about 150 mm from the end 81 of the first handle section 70. The locking connector 80 is secured to the tube 77 by a screw 85 through a hole 87 in the tube 77.

Figure 8:
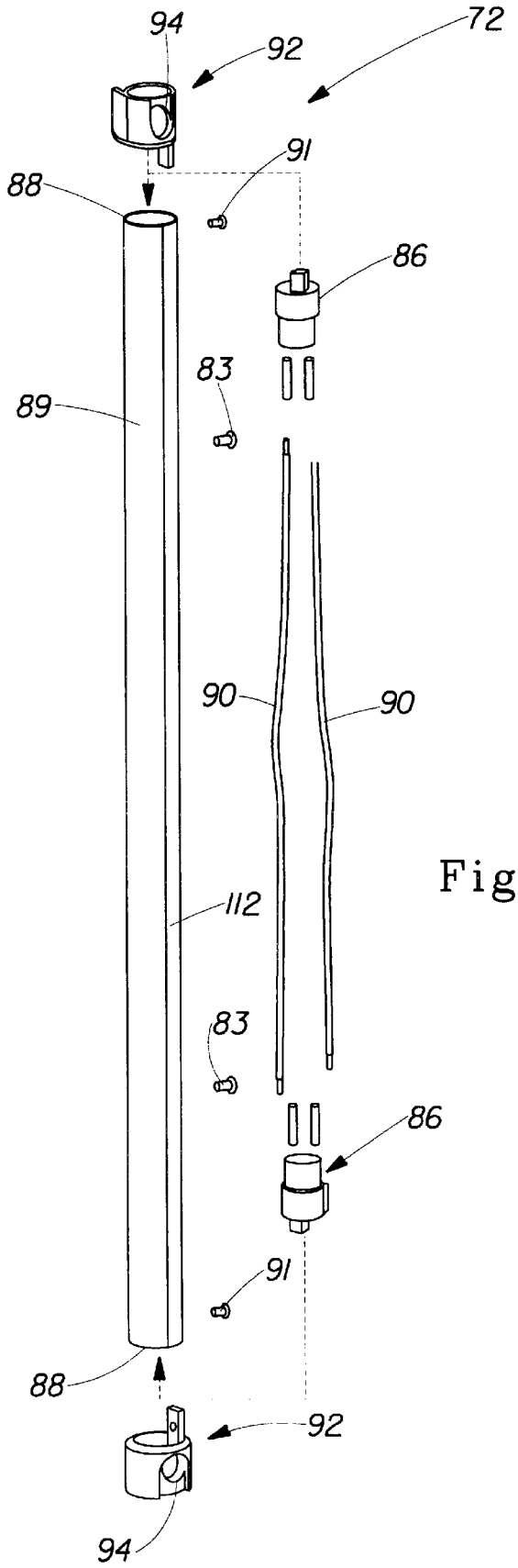
FIG. 8 is an exploded view of the second handle section of the floor mop of FIG. 1.
Figure 9:
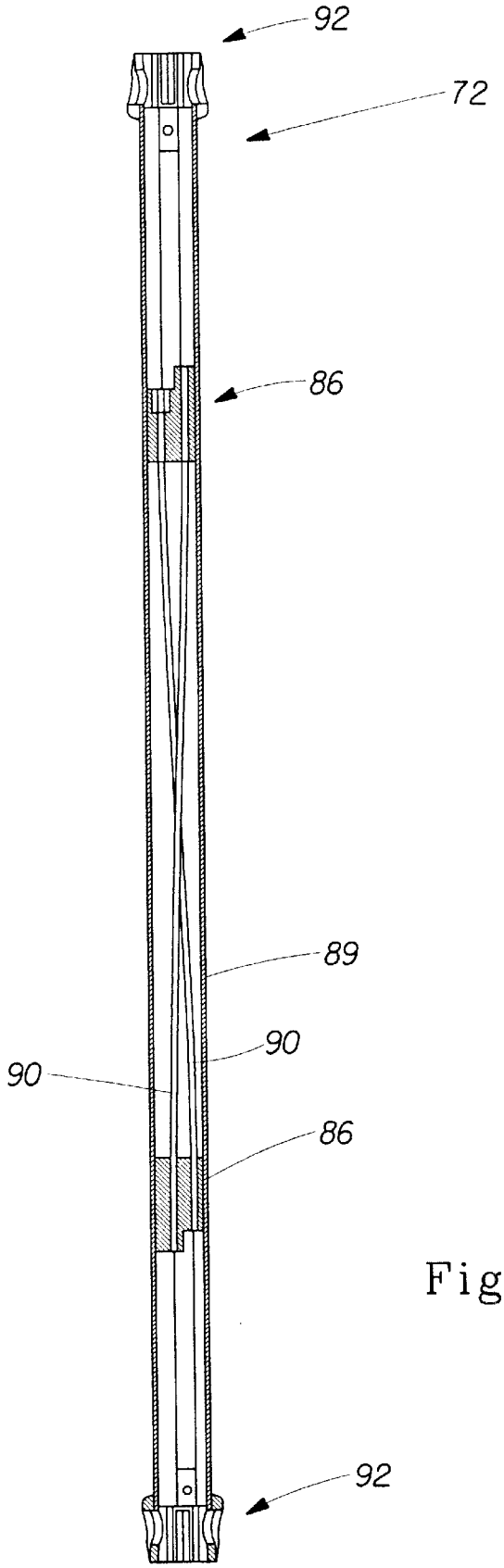
FIG. 9 is a cross-sectional side view of the second handle section of the floor mop of FIG. 1.

As shown in FIGS. 8 and 9, the middle or second handle section 72 includes a tube 89 and two internal electrical connectors 86 disposed within the tube 89 adjacent, and preferably offset from, each end 88 of the tube 89. Electrical wires 90 disposed within the tube 89 interconnect the internal electrical connectors 86. More preferably, each internal electrical connector 86 is disposed at least about 15 mm from its respective adjacent end 88 of the tube 89. Most preferably, each internal electrical connector is disposed between about 15 mm and about 240 mm from its respective adjacent end 88. Locking connectors 92 having holes 94 are disposed at each end 88 of the tube 89. As discussed more fully hereafter, the prongs 82 of the locking connector 80 engage the holes 94 of the locking connector 92 to secure the first handle section 70 to the second handle section 72. The internal electrical connectors 86 are secured to the tube 89 by screws 83 while the locking connectors 92 are secured to the tube 89 by screws 91.

Figure 11:
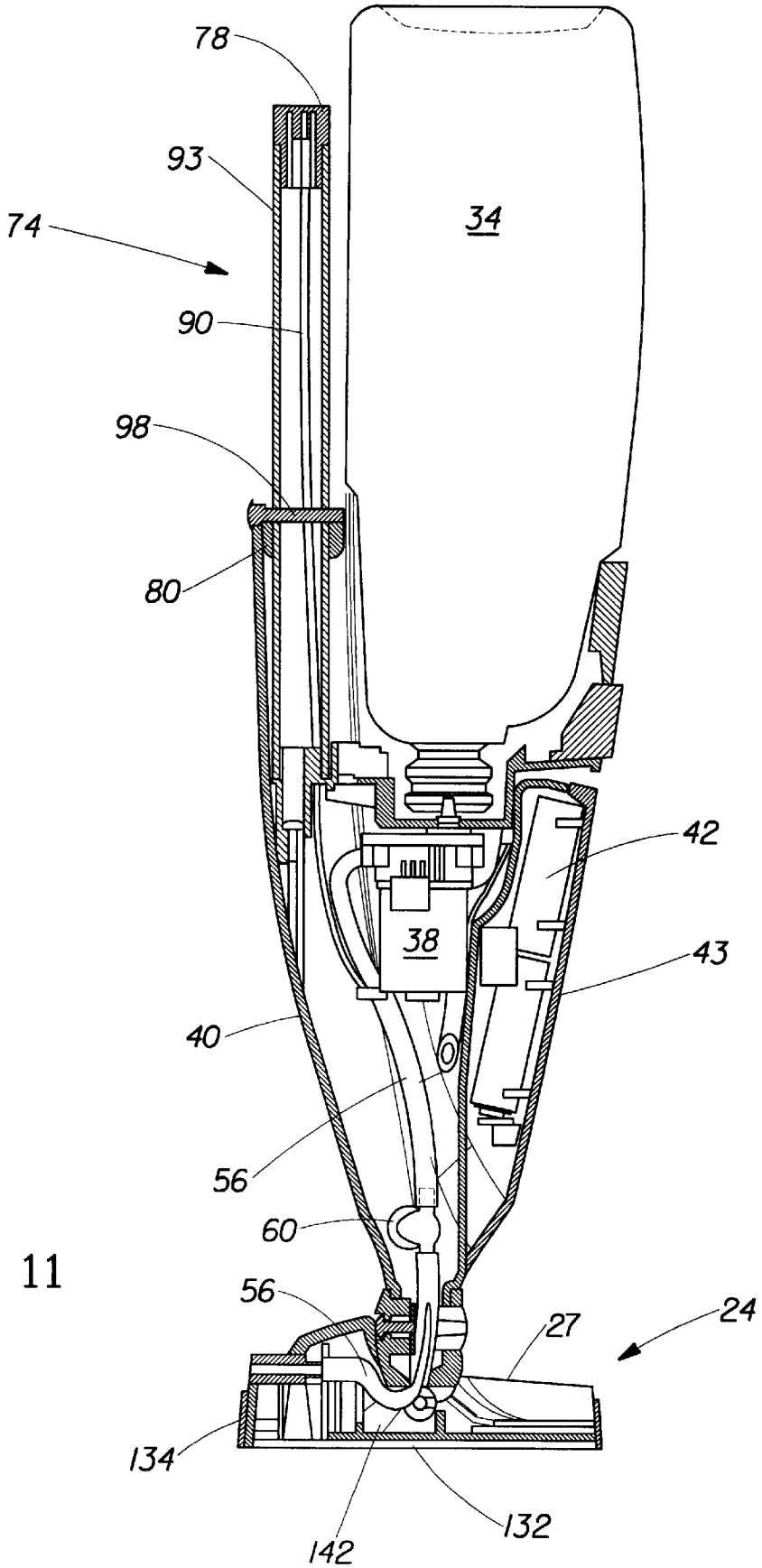
FIG. 11 is a cross-sectional side view of the of the third handle section, housing, and mop head of the floor mop of FIG. 1.

Referring to FIGS. 10 and 11, the third handle section 74 has an external electrical connector 78 disposed at the end 193 of a tube 93. A locking connector 80 having prongs 82 is disposed at about the midpoint of the tube 93 of the third handle section 76. A screw 98 passes through the locking connector 80 and through the third tube 93 to secure both to the canister housing 40. One of the electrical wires 90 is connected to the voltage source 42 and the other electrical wire 90 is connected to the electric motor 38. The electrical wires 90 are disposed within the tube 93 and canister housing 40. An interconnecting electrical wire 100 disposed within the canister housing 40 is connected between the voltage source 42 and the electric motor 38 to complete the electrical circuit between the voltage source 42, electric motor 38, and switch 44.

Figure 12:
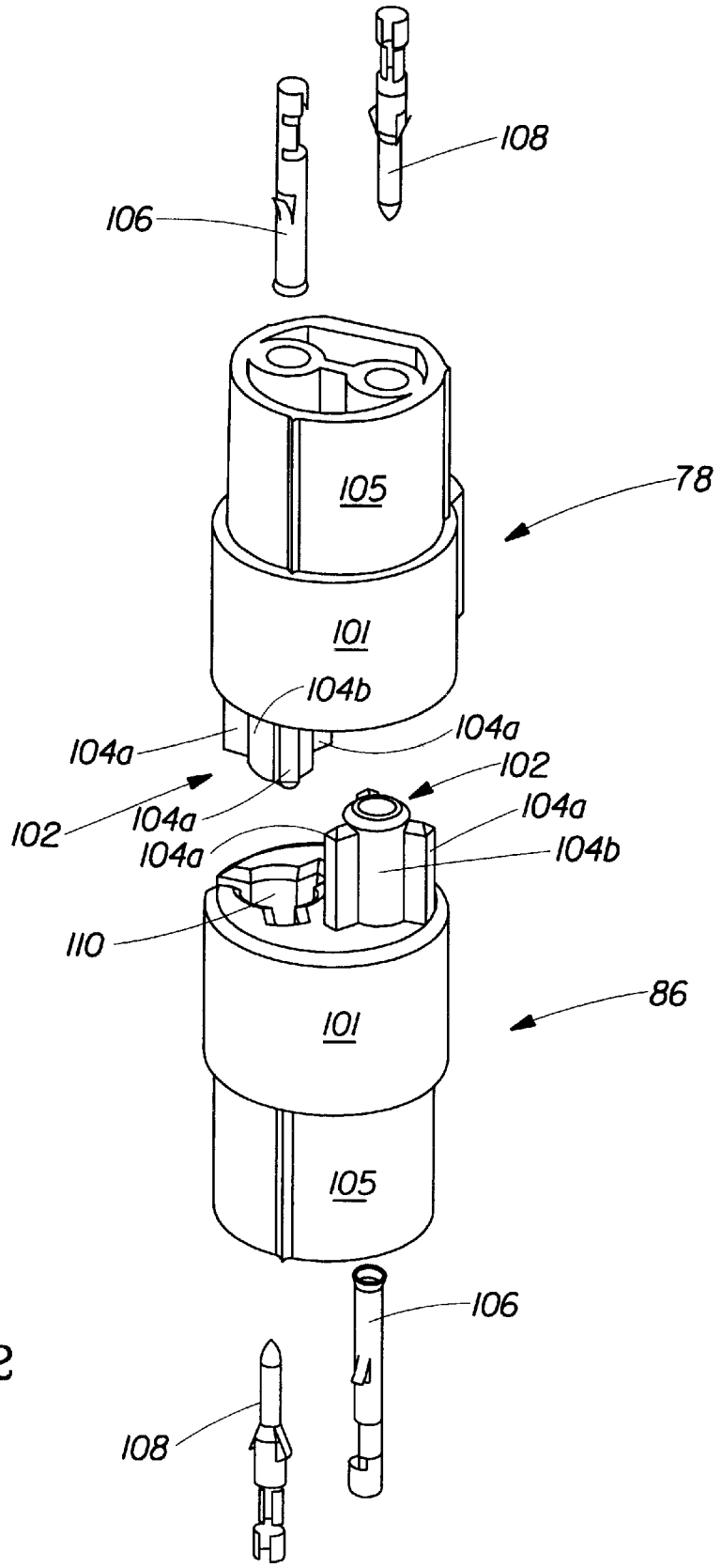
FIG. 12 is an exploded perspective view of a pair of electrical connectors made in accordance with the present invention and suitable for use with the floor mop of FIG. 1.
Figure 13:
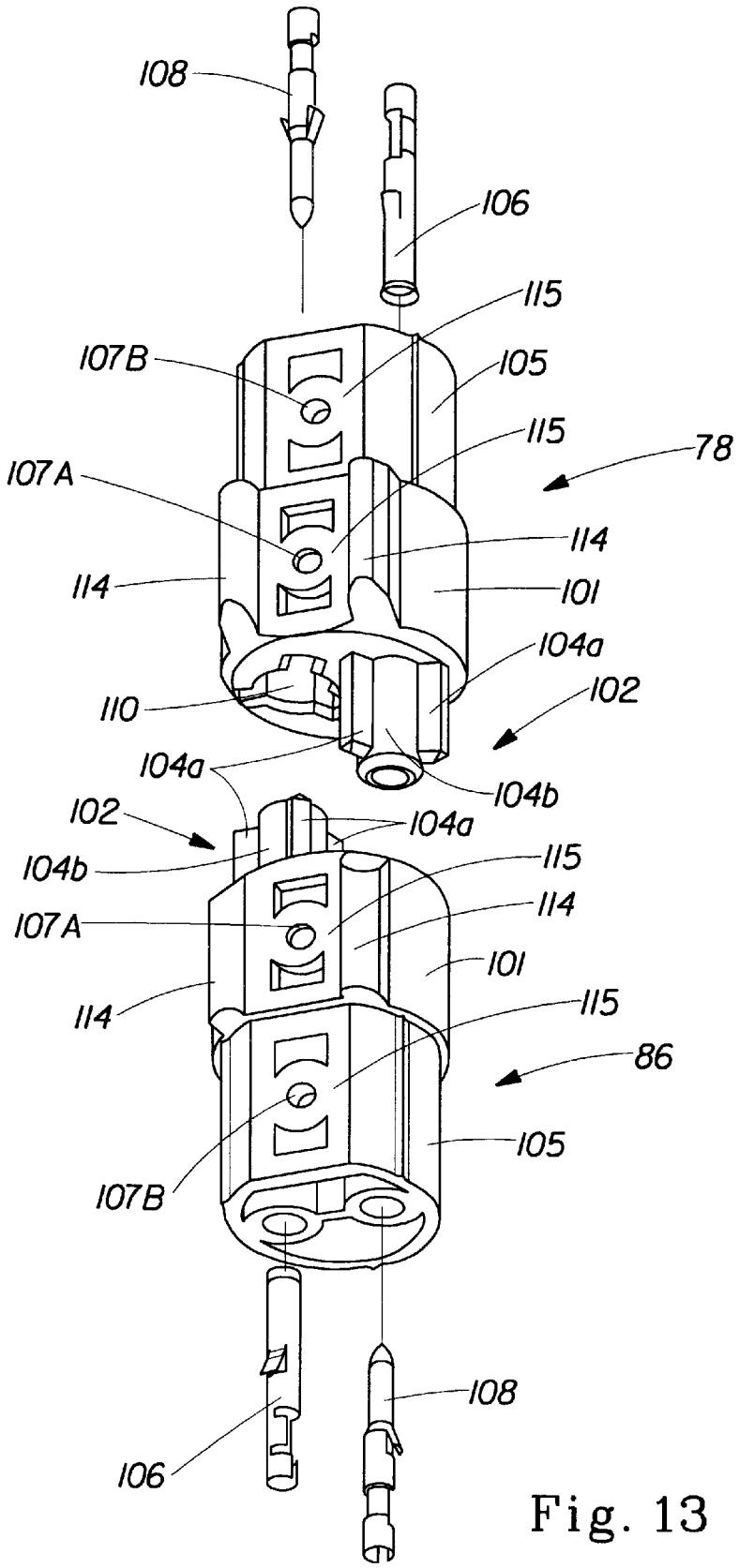
FIG. 13 is an exploded perspective view of the pair of electrical connectors of FIG. 12, wherein the opposite side is illustrated.

Referring to FIGS. 12 and 13, the configuration of the internal and external electrical connectors 86 and 78 will now be described in greater detail. As will be appreciated, the configuration of the external electrical connector 78 is a mirror image of the configuration of the internal electrical connector 86. As such, the arrangement of the internal electrical connector 86 will be described herein by way of example for all the electrical connectors. The internal electrical connector has first portion 101 to which is attached a plug 102 with a plurality of ribs 104*a* extending radially from a substantially cylindrical, hollow post 104*b*. The ribs 104*a* assist in transmitting torque between the handle sections when assembled. A second portion 104*b* having an outside diameter which is less than the outside diameter of the first portion 101 is connected to the first portion 101. A split electrical collar 106 which is connected to one of the electrical wires is located within the plug 102 and passes through the first and second portions of the electrical connector as well as least a portion of said hollow post 104*b*. Blind screw holes 107A and 107B (FIG. 13) are disposed in both the first and second portions of the electrical connector for threadably receiving the screws 83. Preferably, a screw 83 engages blind screw hole 107A of the internal electrical connector 86 while a screw 83 engages blind screw hole 107B of external electrical connector 78 so that each electrical connector is securely attached to its respective tube. An electrical pin 108 which passes through the first and second portions 101 and 105 is disposed within a hole 110 of a socket having a shape which substantially matches the external shape of the plug 102 so that the plug 102 from the external electrical connector 78 can slidably engage the hole 110 of the mating internal electrical connector 86. During the engagement, the electrical pin 108 engages the electrical split collar 106 to form an electrical connection there between. As used herein, the terms "plug" and "socket" are intended to refer to complimentary male and female structures which engage each other. While the previously described electrical connectors are most preferred, it is contemplated that other electrical connectors can be provided. For example, each electrical connector might contain only male or only female structures rather than the described plug and socket arrangement. Alternatively, the electrical connectors might be combined with the locking connectors. Further, spring-biased connectors might be employed to insure electrical contact when assembled.

As best seen in FIG. 8 (the cross-sectional shape of the tube 89 of FIG. 8 being also representative of the cross-sectional shape of tubes 77 and 93), tube 89 is substantially circular in cross section with the exception of a substantially flat or planar guide surface 112 which preferably extends the length of the handle section. The first and third handle sections 70 and 74 preferably have outside diameters which are about equal and which are slightly less than the inside diameter of the tube 89 of the second handle section 72 so that the handle sections 70 and 74 can slide into the hollow interior of the tube 89, as discussed more fully hereafter. The internal and external electrical connectors have protrusions 114 (FIG. 13) disposed adjacent a flat 115 of the first portions 101. As discussed more fully hereafter, the protrusions 114 and flats 115 of the external electrical connector 78 cooperate with the locking connectors 92 and the flat portion 112 of the tube 89 to align and guide assembly of the handle sections. More particularly, these features cooperate to align and slidably guide external electrical connectors 78 into the ends 81 and 193 of the first and third handle sections 70 and 74, as shown in FIGS. 7 and 11, respectively, until the first portions 101 of the external electrical connectors bottom or engage the ends 81 and 193 of these tubes.

Figure 14:
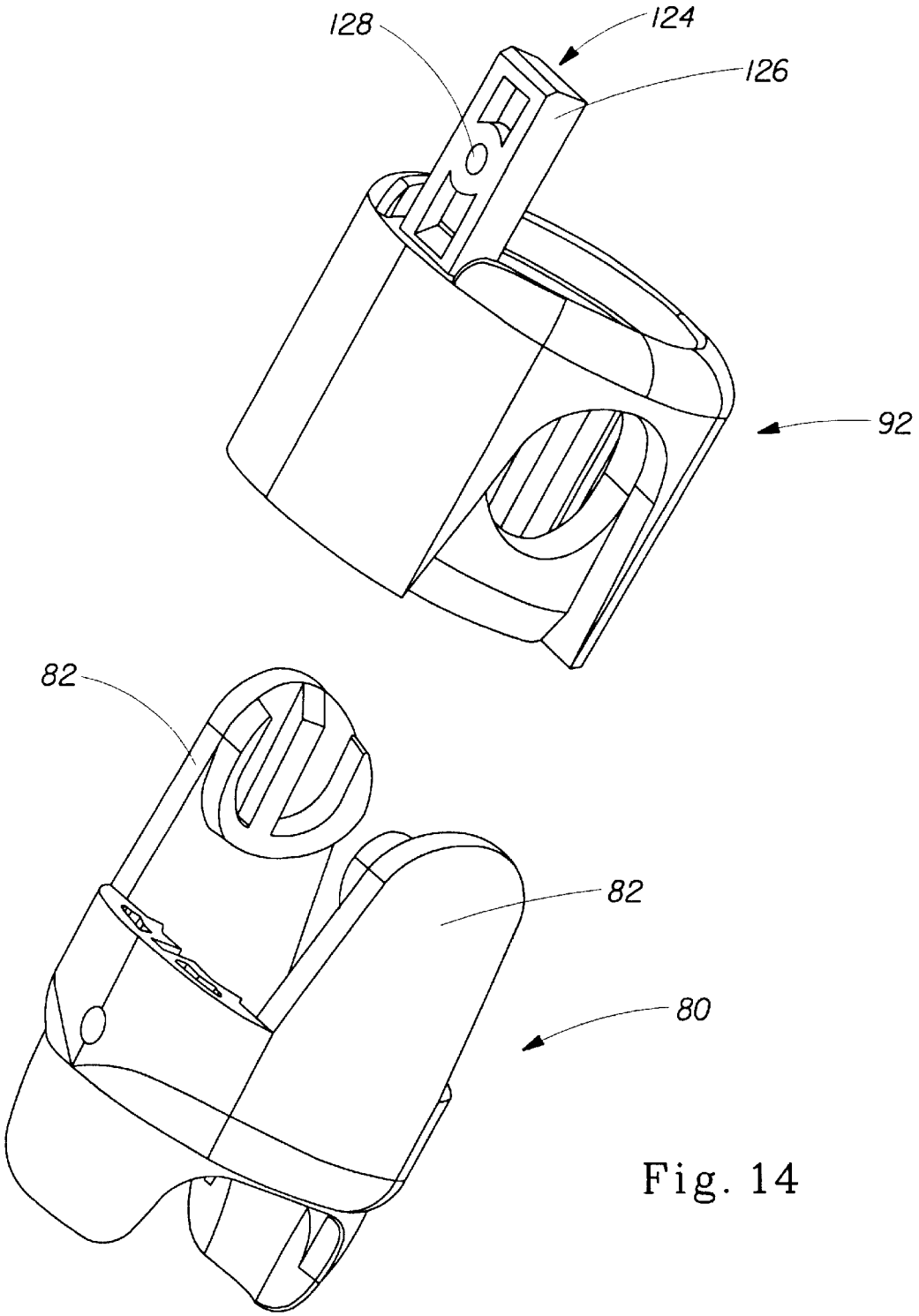
FIG. 14 is a perspective view of a perspective view of a pair of locking connectors made in accordance with the present invention.
Figure 15:
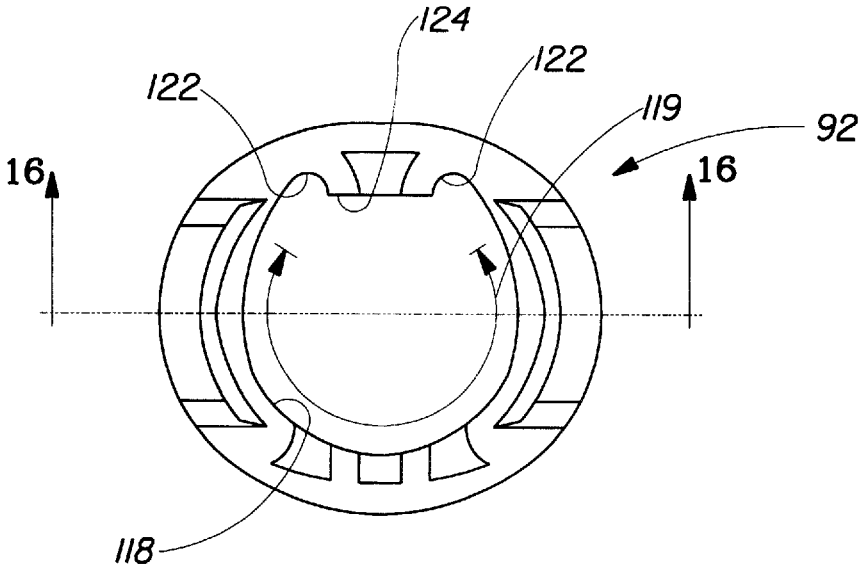
FIG. 15 is an end view of the locking connector.
Figure 16:
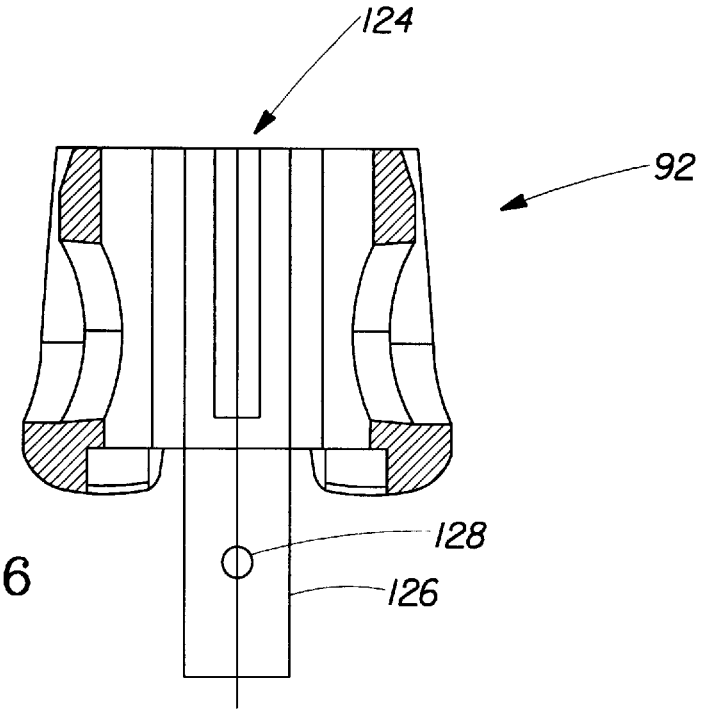
FIG. 16 is a cross sectional side view of the locking connector of FIG. 15, taken along line 16—16 thereof.

Referring to FIGS. 14 and 15, the locking connectors 80 and 92 will now be described in greater detail. The locking connector 92 has an inner surface 118 (FIG. 15), a portion 119 of which approximates the size and shape of the cylindrical outer surface of the tube 77 and external electrical connector 78 of first handle section 70 and the tube 93 and external electrical connector 78 of the third handle section 74. The inner surface 118 also approximates the surface defined by the inside diameter of the tube 89 of the second handle section 72. Grooves 122 are disposed along a portion of the inner surface 118 to slidably receive the protrusions 114 of the external electrical connectors 92. A portion of the grooves 122 are preferably defined by the track 124 which is aligned with the flat surface 112 of the second handle section 72 when assembled, as best seen in FIG. 9. An extension 126 of the track 124 is disposed adjacent the flat surface 112 such that the retaining screw 83 can pass through the flat surface 112 into the hole 128 of the extension 126 to secure the locking connector 92 to the second handle section 72. The grooves 122 cooperate to initially align the external electrical connector 78 with the locking connector 92, thereby also aligning the first and third handle sections 70 and 74 with the second handle section 72 so that the internal and external electrical connectors 78 and 86 are aligned for engagement of the electrical pins and collars 106 and 108. After the protrusions 114 have passed through the grooves 122 as the first and third handle sections are pushed into second handle section 72, the engagement of the track 124 with the flat surfaces of the first and third handle sections maintains the relative angular alignment between the handle sections. The handle sections are pushed together until the prongs 82 engage the holes 94. The overlap of the handle sections when assembled due to the insertion of one handle section into another provides a handle 22 having an increased stiffness, which is especially useful in scrubbing applications. In addition, the plug and socket arrangement and ribs 104*a* of the electrical connectors, the hole and prong locking connectors, and the flat surface of the handle tubes all cooperate to transmit torque through the handle 22 to the mop head 24.

Figure 17:
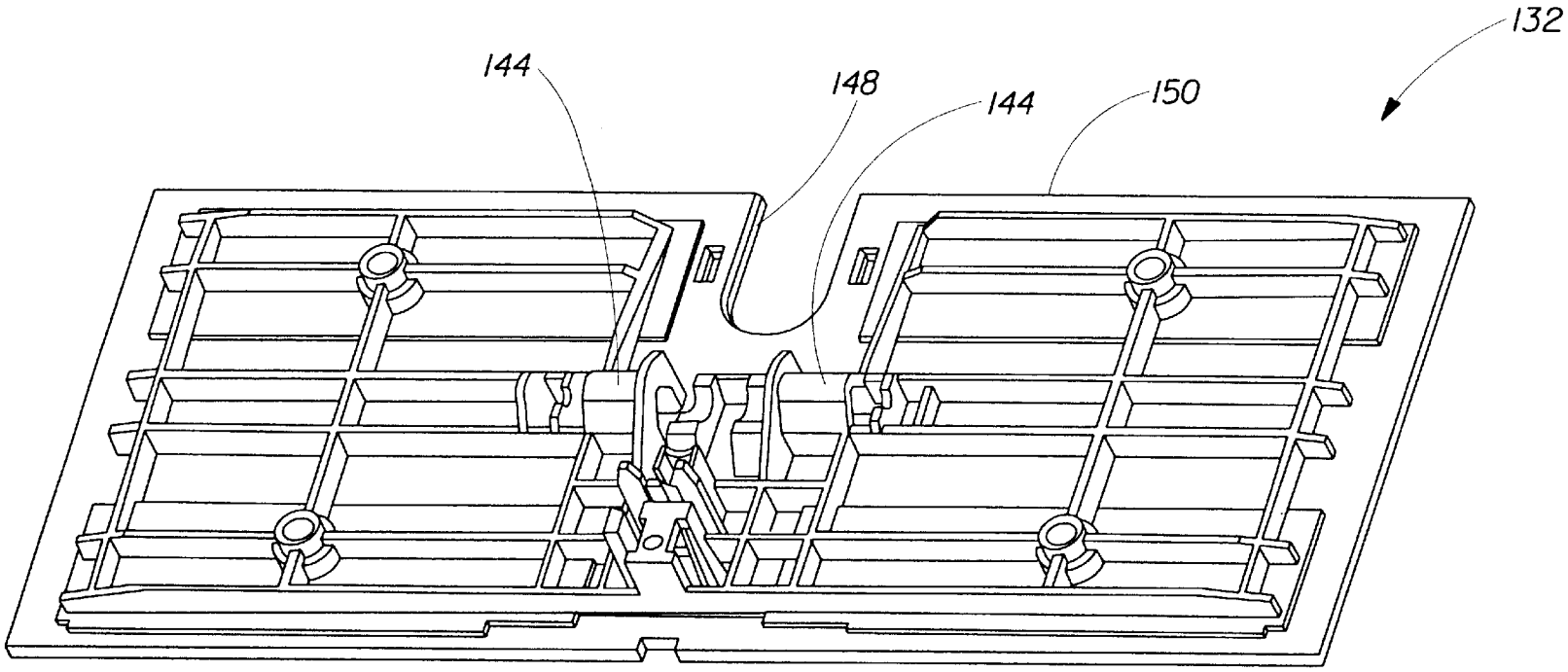
FIG. 17 is a perspective view of a lower plate of the mop head of FIG. 1.

Referring to FIGS. 10 and 17 and in accordance with another aspect of the present invention, the mop head 24 will now be described in greater detail. The mop head 24 comprises the upper plate 27, a lower plate 132 and a bumper 134 sandwiched between the upper and lower plates. The lower plate 132 includes a substantially planar bottom surface 136 and a plurality of longitudinal and transverse stiffening ribs 138. The upper and lower plates 27 and 132 are interconnected by one or more screws which extend through the bottom surface 136 of the lower plate into the upper plate 27. The combination of the upper and lower plates 27 and 132 creates a "torsion box" which resists flexure of the mop head 24 during the mopping and scrubbing process while still providing a substantially planar bottom surface 136 for attachment of the cleaning substrate 28 as well a cavity 142 (shown in FIG. 11) between the upper and lower plates for routing of the flexible fluid line 56 to the spray nozzle 26 attached to the mop head 24, thereby protecting this fluid line. Yet further, the combination of the upper and lower plates 27 and 132 having the cavity 142 there between provides space for a pair of opposed pin holders 144 which receive the joint pin 146. The joint pin 146 secures the universal joint 24 to the lower plate 132 as well as provides an axis about which the universal joint 24 can rotate. Since the universal joint 24 is directly coupled to the lower plate 132, the torque from the handle 22 is transmitted through the universal joint to the lower plate. The upper plate 27 provides the same function as the stiffening ribs 138 by resisting flexure of the lower plate 132 during use.

The upper and lower plates 27 and 132 also include cut-outs 148 adjacent the trailing edges 150 of the plates. The cut-outs 148 provide an inspection window for easy viewing of the backside of a cleaning substrate 28 attached to the floor mop 20. Inspection of the backside of the cleaning substrate during use is advantageous for a user of the mop 20 so that the user can determine when the cleaning substrate has become soiled and should be replaced. The cut-outs 148 preferably have a surface area of at least about 1 $cm^2$ and, more preferably, between about 4 $cm^2$ and about 8 $cm^2$. In an alternate preferred embodiment, a portion, or the entire surface, of the upper and lower plates 27 and 132 can be formed from a translucent or transparent material, such as a transparent plastic, so that the backside of the cleaning substrate can be easily viewed by a user of the floor mop 20.

Figure 18:
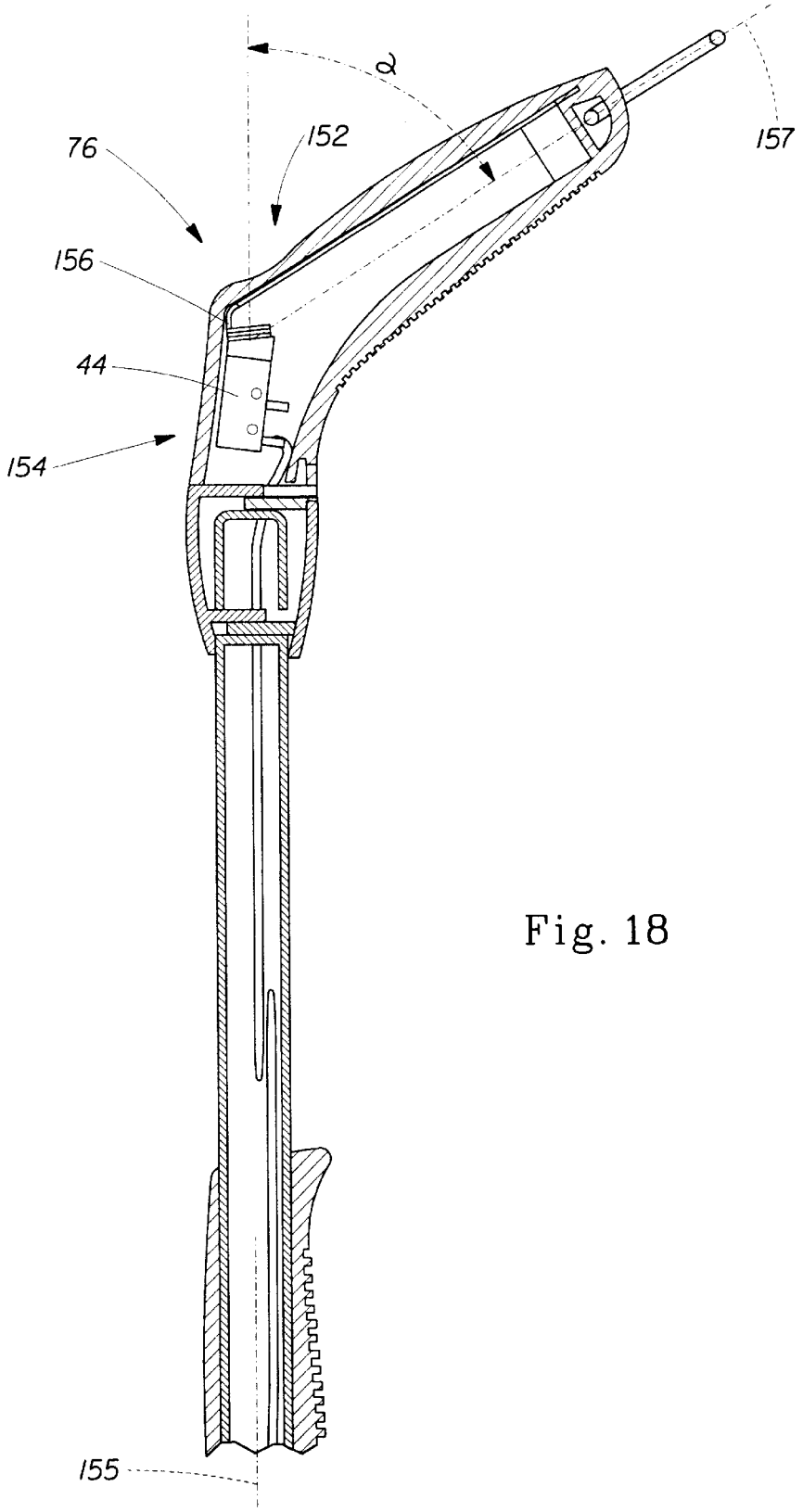
FIG. 18 is a cross-sectional side view of the handle of the first handle section of the floor mop of FIG. 1.

Referring to FIG. 18 and in accordance with still another aspect of the present invention, the handle grip 76 has a handle portion 152 and switch portion 154. The switch portion 154 is oriented along the longitudinal axis 155 of the tubes 89 and includes the switch 44. The switch 44 is preferably recessed below the outer surface of the switch portion 154 to prevent inadvertent actutation of the switch. In addition, the handle grip 76 has a ridge 156 disposed between the handle portion 152 and the switch portion 154. Preferably, the angle $\alpha$ between the longitudinal axis 157 of the handle portion 152 and the longitudinal axis (represented by axis 155) of the switch portion 154 is between about 90 degrees and 140 degrees. More preferably, the angle $\alpha$ between the handle portion 152 and the switch portion 154 is between about 100 degrees and about 130 degrees. Selection of the proper angle $\alpha$ provides a handle which separates the switch 44 from the gripping portion of the handle to prevent accidental activation of the electric motor as well as providing adequate control of the mop head and torque transmission from the user of the floor mop 20 to the mop head, all without, generally, having a user lift or raise his or her hand from the handle portion 152 of the handle grip 76.

Figure 19:
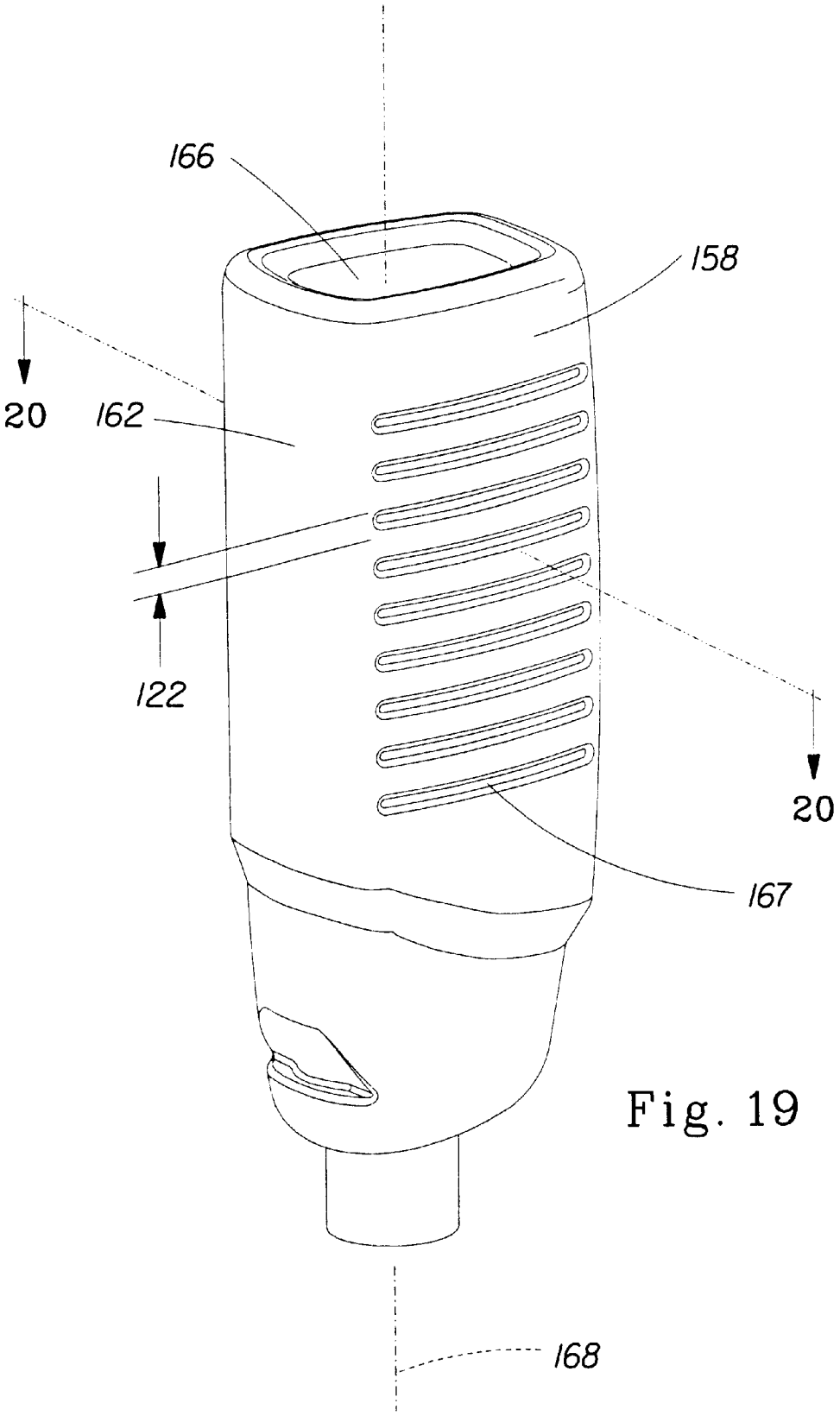
FIG. 19 is a perspective view of a bottle made in accordance with another aspect of the present invention and suitable for use with the floor mop of FIG. 1.
Figure 20:
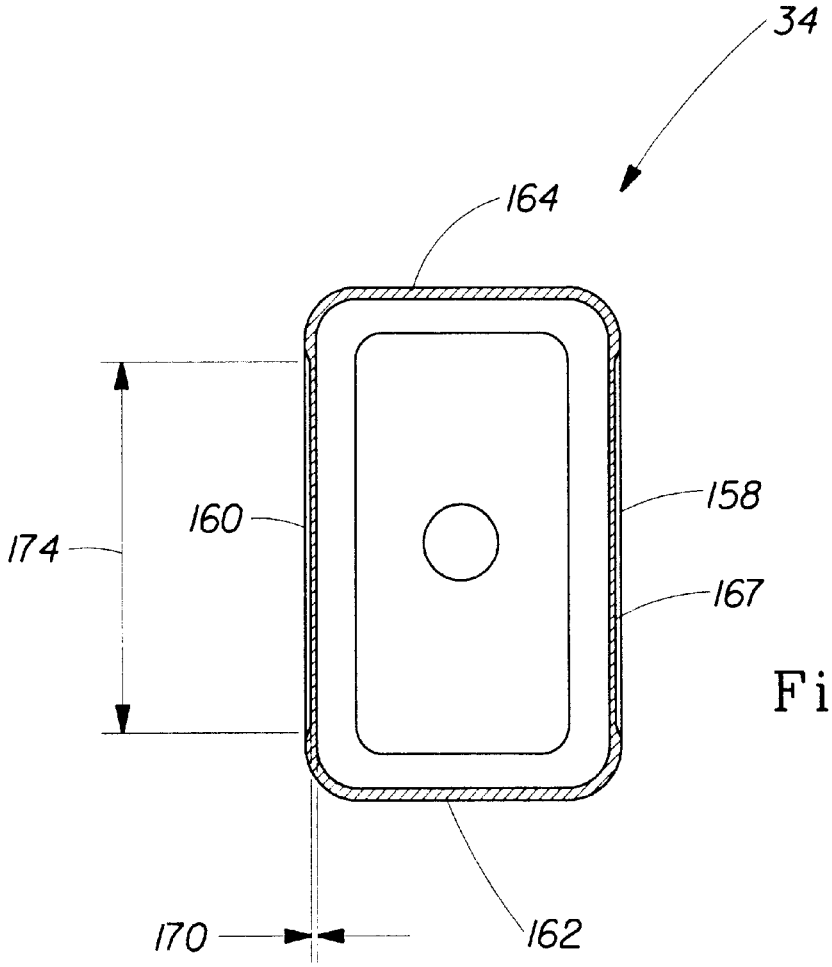
FIG. 20 is a cross-sectional top plan view of the bottle of FIG. 19, taken along line 20—20 thereof.

Referring to FIGS. 19 and 20, the canister 34 will now be described in greater detail in accordance with yet another aspect of the present invention. The canister 34 comprises opposed first and second side walls 158 and 160 and opposed third and fourth side walls 162 and 164. The plan cross-sectional view of the bottle is preferably substantially in the form of a parallelogram or rectangular in order to aid alignment of the canister 34 when it is inserted into the canister housing 40 and to provide a more aestetically pleasing appearance. A bottom wall 166 is interconnected with each of the side walls to form the hollow canister 34.

The size and shape of the side walls of the canister 34 are adapted to cooperate with the liquid delivery system of the mop 20 so that the venting check valve 51 can open to allow venting of the canister 34 for proper and efficient operation of the pump 36. For example, effective priming of the pump, the time period of continuous pump operation, and the spray characteristics of the mop 20 can be affected by the venting performance of the canister 34.

Referring again to FIG. 5, while the canister 34 is preferably situated above the pump 36 so that a static head is provided to the pump inlet 48 for priming of the pump, the canister 34 is also preferably substantially non-deformable (i.e., the walls of the canister do not measurably deflect to substantially affect generation of suction or sub-atmospheric pressure $P_2$ within the canister 34) at the pump generated pressure differential of $P_1$ minus $P_2$. Preferably the difference between the static pressure $P_2$ and the pressure $P_1$, the latter being equal to atmospheric pressure, when the pump 36 is priming (i.e., when the gears of the pump 36 have become immersed in the liquid cleaning composition 35) is sufficient to open the venting check valve 51 as quickly as possible, thereby minimizing unnecessary current draws. In a preferred arrangement, the venting check valve 51 has an opening or cracking pressure of at least about 0.6 Kpa and more preferably is between about 0.6 Kpa and about 20 Kpa for ease of pump priming. In other words, the pump 36 is able to generate a static suction pressure $P_2$ of at least about 0.7 Kpa within the canister 34 and more preferably the static suction pressure is between about 0.7 Kpa and about 20.1 Kpa. Most preferably, the vent valve 86 has a cracking pressure of between about 1 Kpa and about 10 Kpa and the pump 36 is able to generate a static pressure $P_2$ of between about 1.1 Kpa and about 10.1 Kpa.

Figure 21:
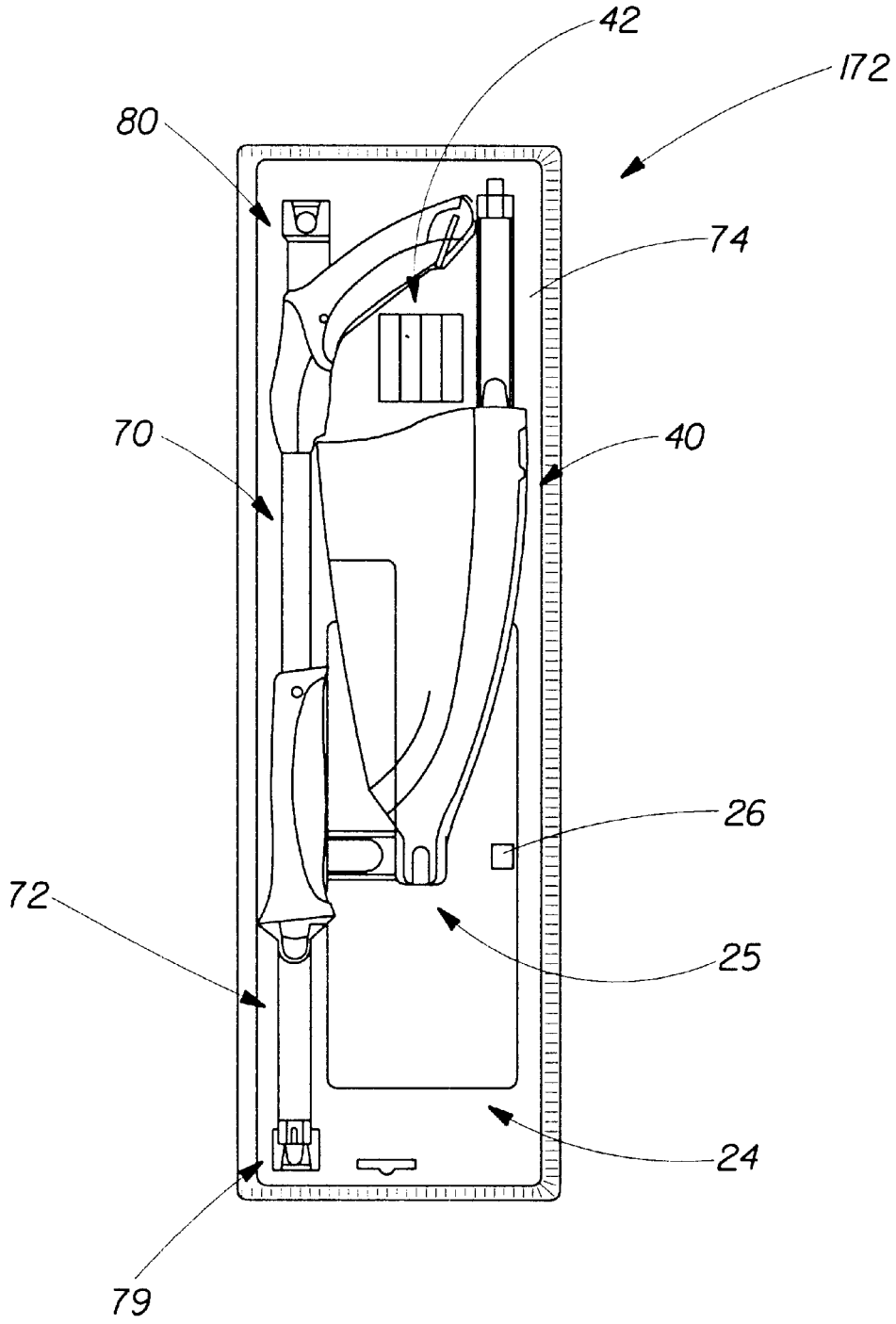
FIG. 21 is a top plan view of a kit, including a package, made in accordance with the present invention.

In order to provide the above-described venting characteristics, which in turn affects performance of the liquid delivery system, the side walls of the canister are substantially non-deformable. More preferably, at least the first and second side walls, which are side walls with the largest surface area, have a deflection which is less than about 0.6 mm when the gage pressure difference between $P_2$ and $P_1$ is between about 10 mbar and about 12 mbar. The deflection of the side walls is measured at the center of each side wall using a caliper or other measuring instrument known in the art. More preferably, the deflection of the side walls is less than about 1.5 mm, and, most preferably the deflection of the side walls is less than about 0.8 mm when the gage pressure difference between $P_2$ and $P_1$ is between about 10 mbar and about 12 mbar in order to provide the proper venting of the canister 34. The stiffness of the side walls can be increased with one or more grooves 167, which are shown in FIG. 19 as disposed on the first and second side walls 158 and 160. For a side wall thickness of between about 0.5 mm and about 1 mm (which provides a cost-effective bottle which is easiest to form by blow molding, injection blow molding, or injection stretch blow molding), the groove spacing is at least about one groove per 15 mm along the longitudinal axis 168 of the canister 34. More preferably, the canister 34 has between about 7 grooves and about 10 grooves on at least the first and second side walls of the canister 34. As shown in FIG. 21, each groove 167 has depth 170 of at least about 2 mm, a width 172 of at least about 2 mm, and a length 174 of at least about 60 mm. The depth of the grooves preferably varies from one end to the other end, with the middle portion being the deepest to gain beam strength by varying the depth of each groove. More preferably, the depth 170 is between about 2 mm and about 4 mm and the width 172 is between about 2 mm and about 4 mm. The groove spacing is one groove between about 10 mm and about 12 mm along the longitudinal axis 168 of the canister 34. While these arrangements are preferred, the groove dimensions and wall thickness can be further varied in combination with the wall shape to achieve the minimum wall deflection for use with a vent valve having a cracking pressure of at least about 0.4 Kpa. In addition, radially outwardly extending ribs having the previously described groove dimensions could be used in place of the grooves.

Figure 22:
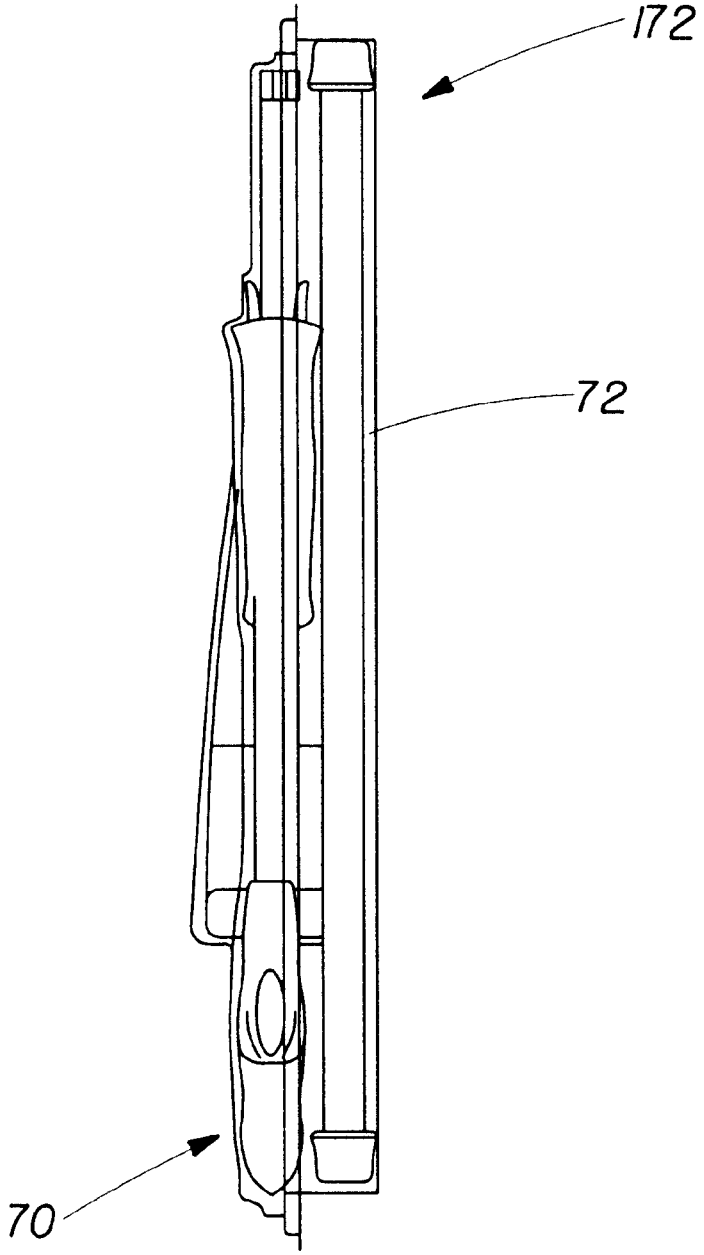
FIG. 22 is a side elevational view of the kit of FIG. 21.

In accordance with another aspect of the present invention, a kit is provided which comprises some or all of the disassembled components of the mop 20. For example, the kit can comprise one or more of the handle sections (e.g., reference numerals 70, 72, and 74) and the subassembly which includes the mop head 24, the universal joint 25, and the canister housing 40. The kit can further include the canister 34 and/or one or more cleaning sheets for use with the mop 20. Because the handle sections incorporate severable electrical connectors, the kit can be arranged within a package 172, as shown in FIGS. 21 and 22, having a length of less than about 80 cm, a width of less than about 25 cm, and a height of less than about 15 cm. As used herein, the phrase "severable electrical connectors" is intended to refer to electrical connectors, which when severed or disassembled, have no electrical continuity there between such that the handle sections are electrically disconnected. The package 172 can be provided in the form of a parallelpiped paper board carton, a vacuum formed plastic container which is complimentary to the shape of the components of the mop 22, and the like. The previously described kit advantageously reduces shipping costs and the amount of retail shelf space required for display and marketing of the mop 20. In addition, the severable electrical connectors allows easy substitution of handle sections to increase or decrease the overall length of the handle 22 as desired. For example, for most arrangements, the first and second handle sections each have a length of less than about 75 cm, and, more preferably, between about 35 cm and 75 cm while the combination of the third handle section, the mop head, the universal joint, and the canister housing have a folded length (as shown in FIG. 21) of less than about 60 cm and, more preferably, less than about 50 cm.

Figure 23:
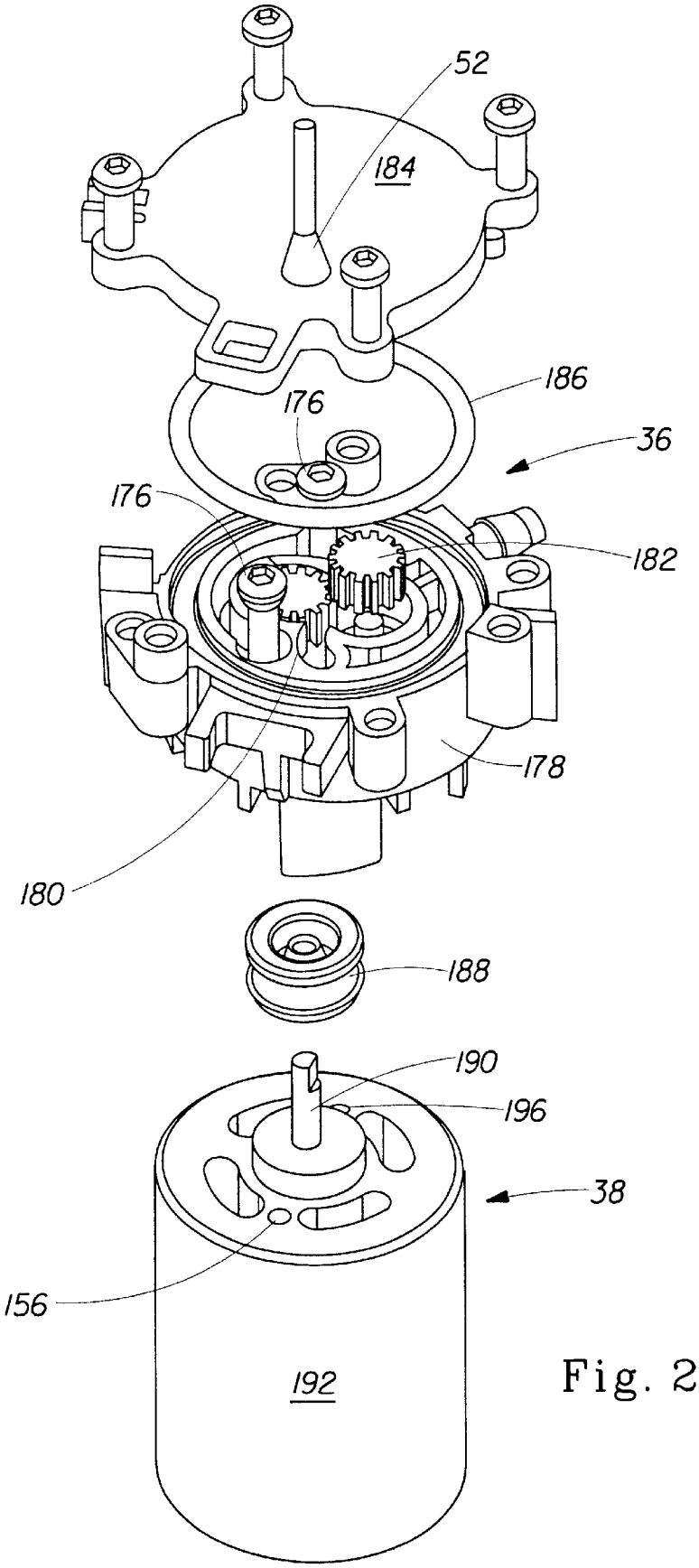
FIG. 23 is an exploded view of an electrical motor, gear pump, seal, and top plate made in accordance with yet another aspect of the present invention and suitable for use with the floor mop of FIG. 1.
Figure 24:
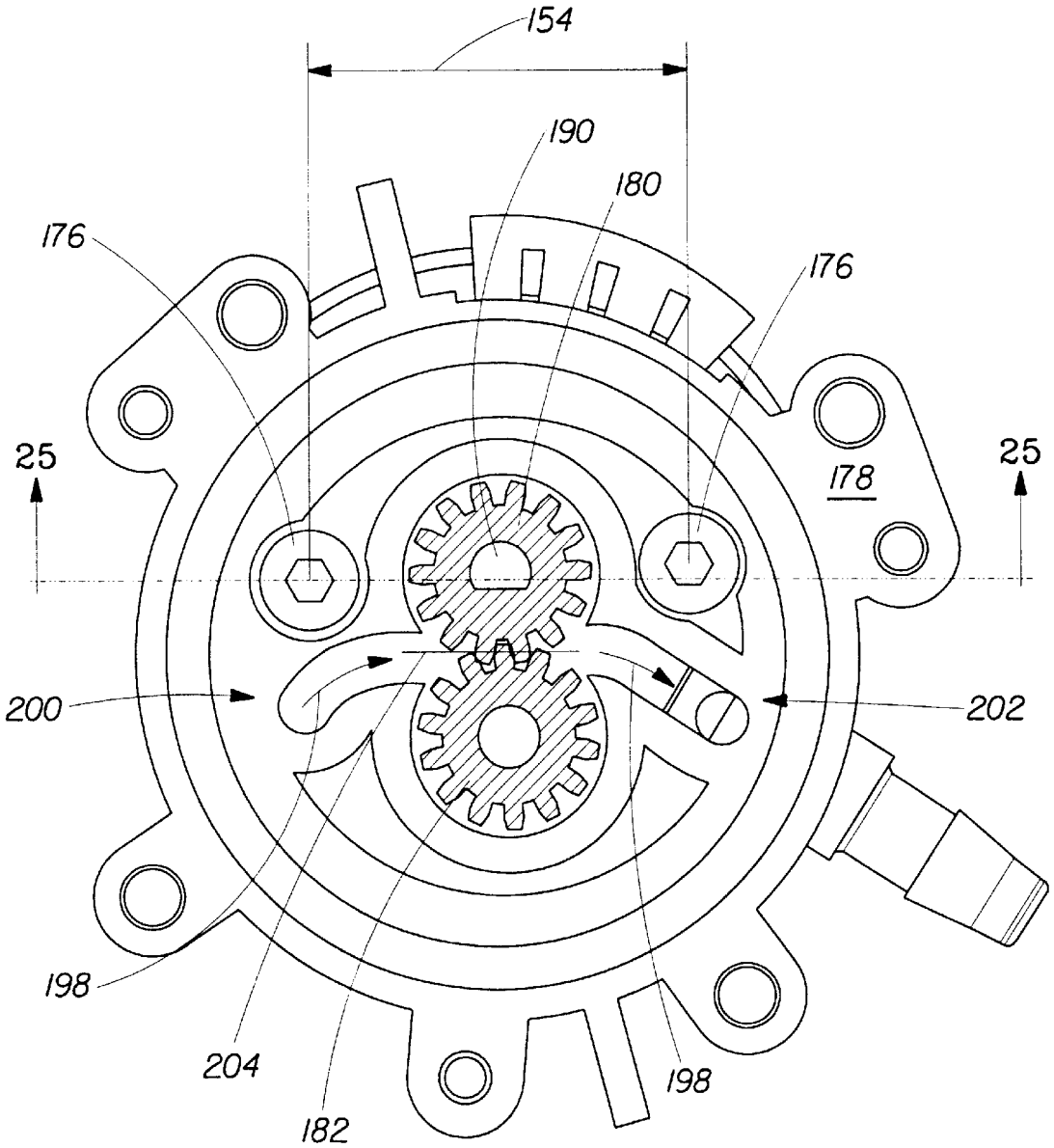
FIG. 24 is a top view of the combination of FIG. 23, wherein the top plate has been removed for clarity.
Figure 25:
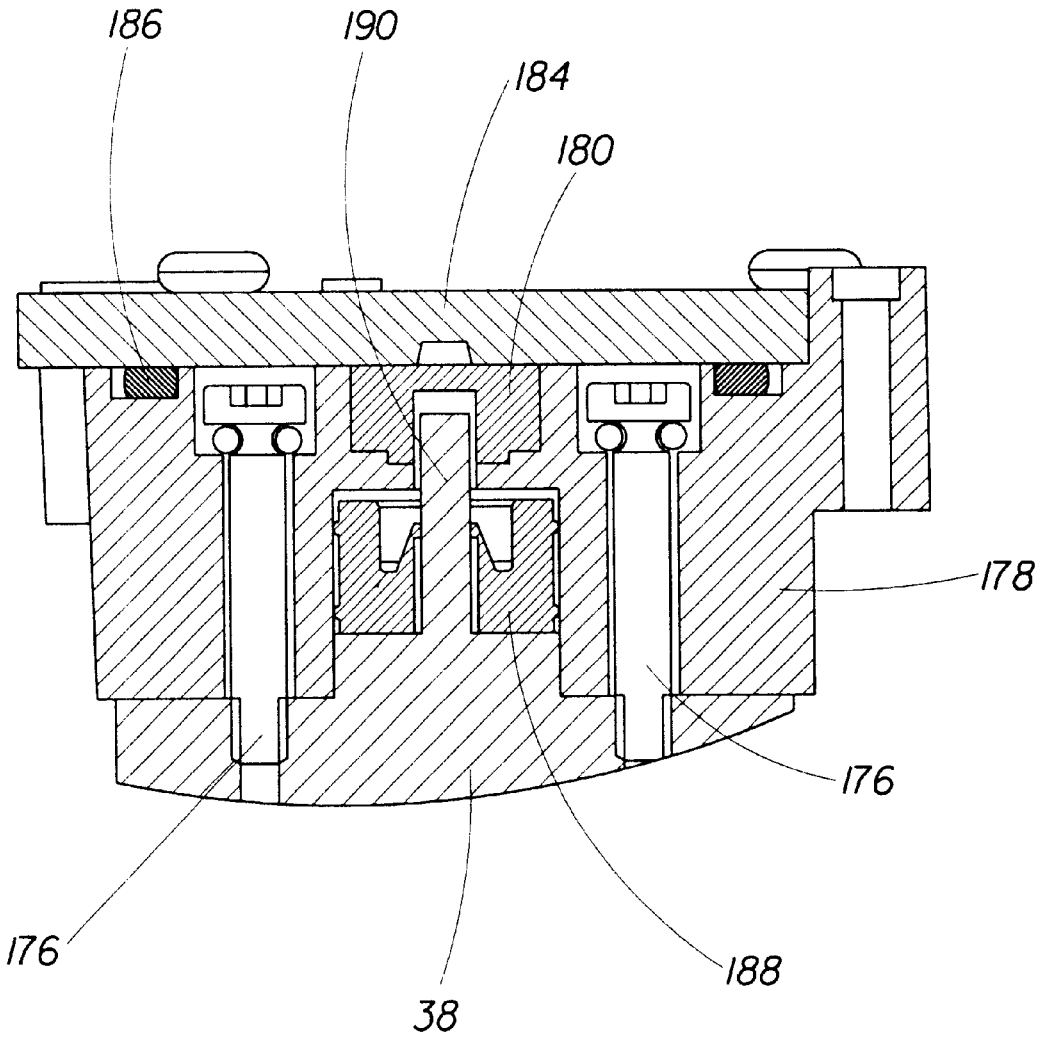
FIG. 25 is a cross-sectional side view of the combination of FIG. 24, taken along line 25—25 thereof, wherein the top plate has been included for completeness.

Referring to FIGS. 23 to 25 and in accordance with yet another aspect of the present invention, the electrical motor 38 and the gear pump 36 will now be described in greater detail. For spraying appliances such as the floor mop 20, there is a continuing desire to minimize the amount of space required for the various appliance components in order to provide an appliance which is lightweight, easy to maneuver and manipulate, and which is less expensive to manufacture. In order to provide a compact motor and pump combination, the electrical motor 38 is directly coupled to the gear pump 36 by two screws 176, as best seen in FIG. 23. The gear pump 36 comprises a pump housing 178, a drive gear 180, an idler gear 182, a face plate 184 having the pump inlet 52, a first seal 186 disposed between the pump housing 178 and the face plate 184, and a second seal 188 about the motor shaft 190. The pump housing 178 is directly attached to the motor housing 192 of the electrical motor 38 by two screws 176, wherein the drive gear 180 is disposed between the screws 176 and the drive gear 180 is directly attached to the shaft 190 of the electrical motor 38. More preferably, the drive gear 180 is keyed to the shaft 190 and the shaft 190 passes through the motor casing 192. The minimum outside diameter of the motor casing is generally dictated by the motor configuration (e.g., shaft diameter and rotor diameter) which in turn is driven by motor performance. In order to directly couple the gear pump 36 to an electrical motor 38 having a power output of between about 2 watts and about 10 watts at maximum efficiency with a casing outside diameter of less than about 35 mm, and, more preferably less than 30 mm, the screw spacing 194 is preferably between about 9 mm and about 27 mm in order to securely engage the top surface of the casing 192 of the electrical motor 38 while avoiding contact with the motor shaft bearing. The gear pump housing 178 also preferably engages the motor casing 192 when the screws threadably engage the casing screw holes 196 (FIG. 23), as best seen in FIG. 25, in order to provide a compact configuration. Due to the compact size and shape of the electrical motor and gear pump combination, it can be used in a variety of appliances and therefore with a variety of aqueous liquids. More preferably, the liquids have a pH range of between about 2 and about 14. Most preferably, the liquids have a pH range of between about 4 and about 11. In order to accommodate liquids having such a broad pH range, the idle gear 182 and the drive gear 184 are formed from an acetal copolymer or other material which is compatible with the pH range. As used herein, the term "compatible" is intended to refer to a polymer or other material which substantially maintains its dimensional characteristics, weight, tensile modulus, and/or yield strength when exposed to a liquid product for at least 6 months at 20 degrees C. to 50 degrees C. However, acetal copolymers have a tendency to swell in aqueous liquids, thereby affecting gear performance, such as efficiency, and potentially leading to gear binding during use. Thus, in order to accommodate a broad pH liquid range in a directly coupled motor and pump arrangement (i.e., where the gear size is constrained due to the spacing of the screws) while still providing a motor/pump efficiency of at least about 5%, the drive gear 180 and the idle gear 182 preferably have the following shape characteristics while accommodating a closely spaced screw arrangement for compactness:

| | Driven and Drive Gears |
|---|---|
| Number of Teeth | 14 |
| Module | 0.5 |
| Pressure Angle | 20 degrees |
| Tooth Thickness | 0.785 mm |
| Outside Diameter | 7.95 mm |
| Root Diameter | 6.033 mm |
| Tooth Tip Radius | 0.203 mm |

In addition, the flow path 198 of the gear pump 36 is preferably downwardly curved away from the screws 176 such that the inlet 200 and the outlet 202 of the gear pump are not tangential with the contact line 204 of the idle and drive gears. This advantageously provides a configuration where the screws are disposed outside the flow pump path, as shown, while accommodating the screw spacing limitations of the directly coupled gear pump. While the directly coupled electrical motor and gear pump 36 have been described herein with respect to the floor mop 20 for simplicity and clarity, it will be appreciated that this arrangement can be used in other electrically operated liquid sprayers. For instance, this arrangement can be incorporated in a hand-held sprayer, other types of floor cleaning implements, home care appliances, etc.

Figure 26:
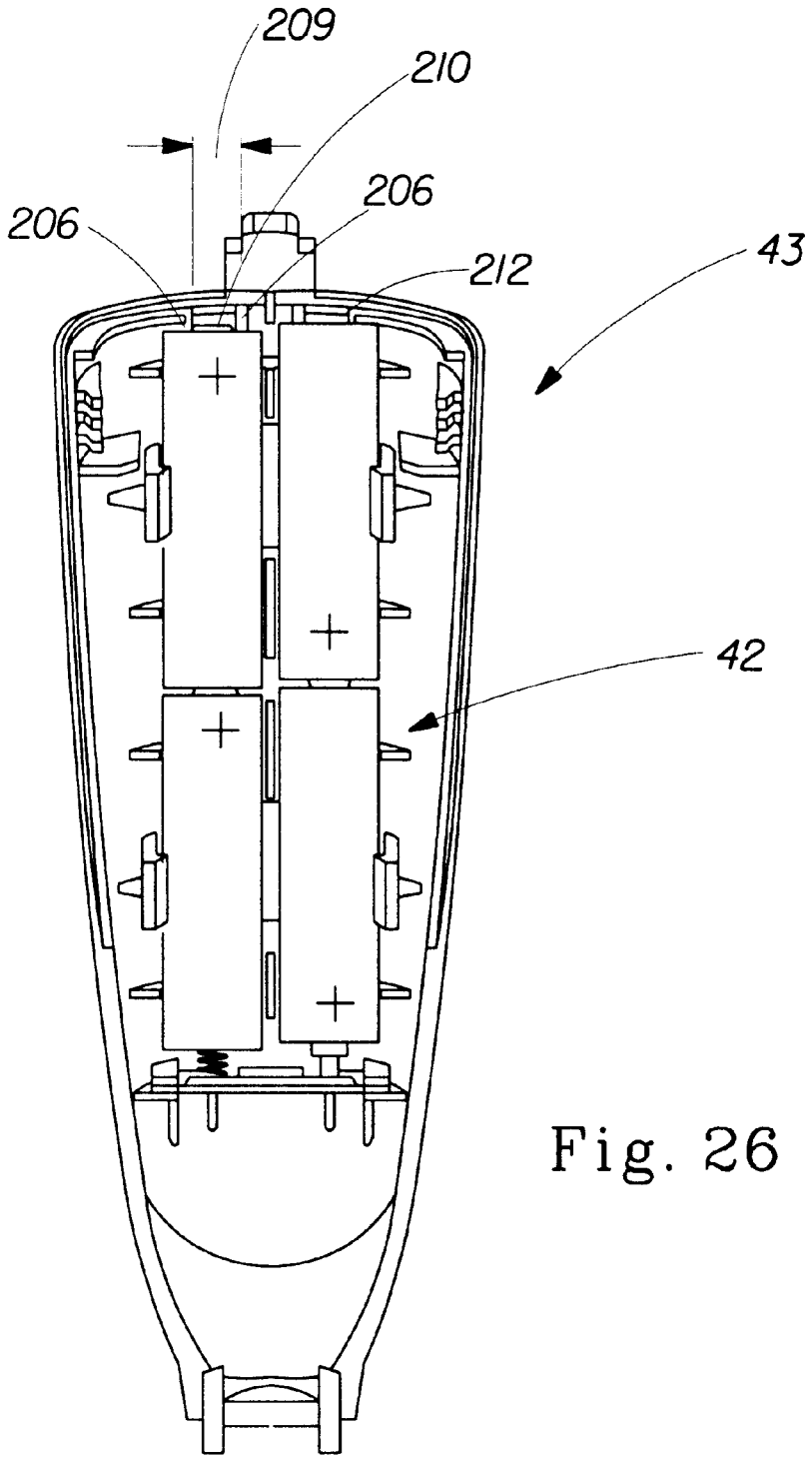
FIG. 26 is top planar view of a battery cradle from the floor mop of FIG. 1 made in accordance with still another aspect of the present invention, wherein four batteries are disposed within the cradle in a first position.
Figure 27:
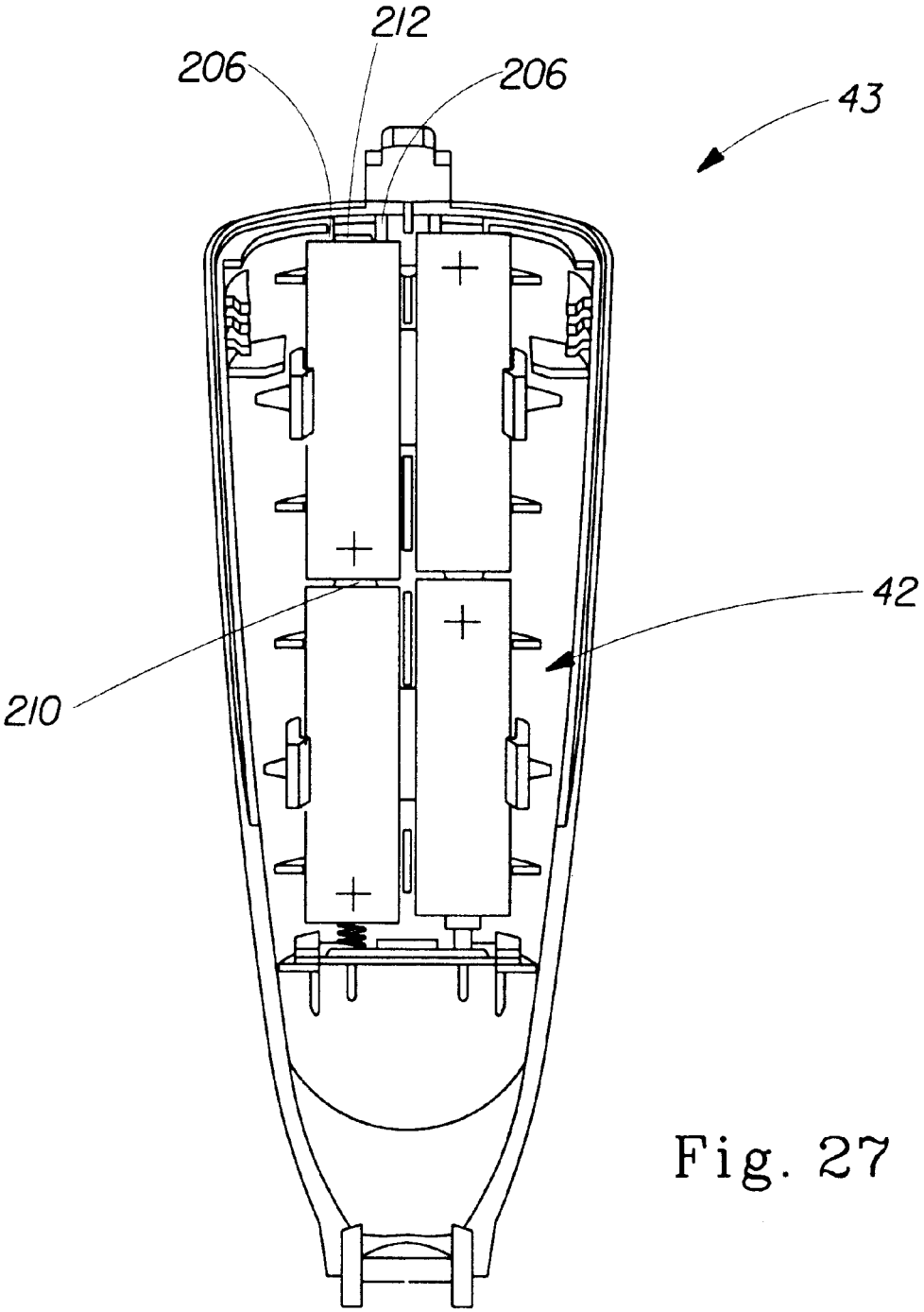
FIG. 27 is a top planar of the battery cradle of FIG. 26, wherein the four batteries are disposed in a second position.
Figure 28:
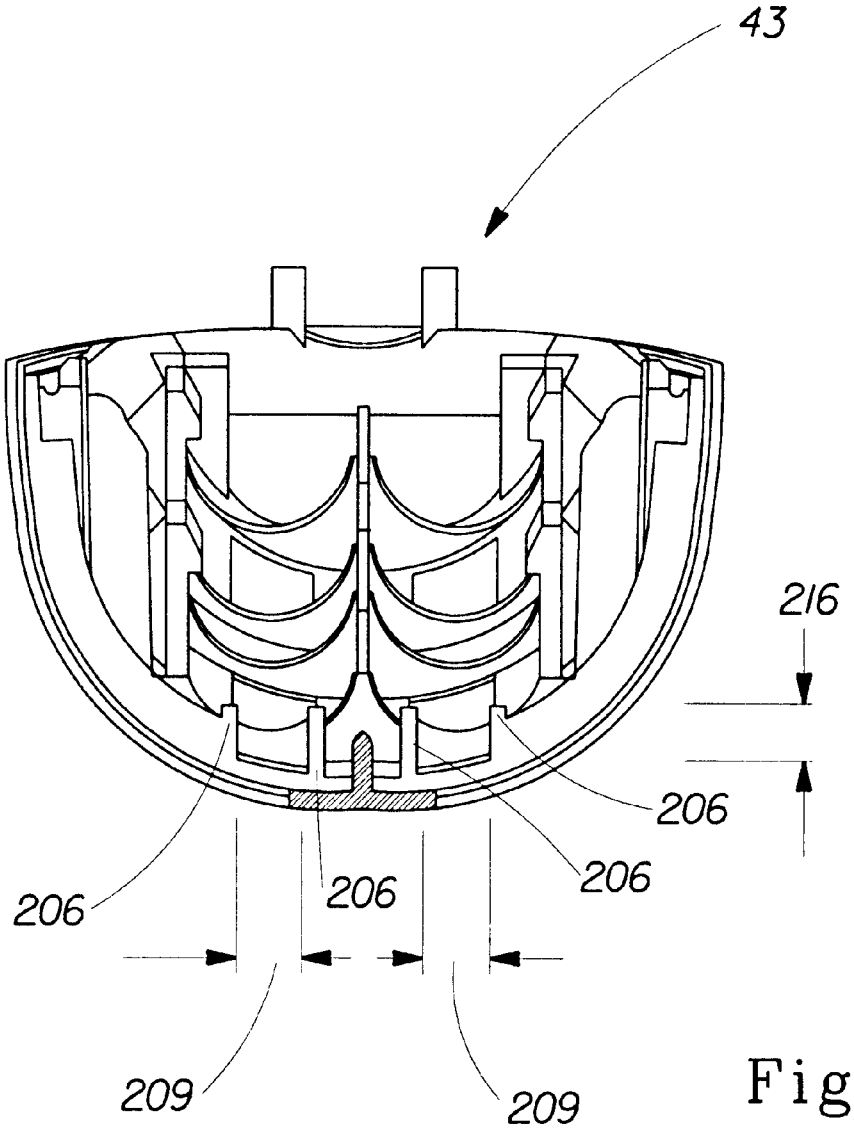
FIG. 28 is a front elevational view of the battery cradle of FIG. 26.

In accordance with another aspect of the present invention and with reference to FIGS. 26 and 27, the battery cradle 43 incorporates at least one, and more preferably two, prongs 206 which are sized to prevent electrical contact between the batteries and the electrical pickups 208 (FIG. 10) adjacent the battery cradle 43 when the batteries are incorrectly inserted into the cradle 43. This can prevent inadvertent reverse operation of the electrical motor 38 which can confuse a user of the floor mop and return liquid or air into the canister 34. The prongs 206 have a gap 209 there between which allows the positive terminal 210 (which is usually in the form of a button having a diameter between about 3 mm and about 5 mm) of the battery to pass there through and contact one of the electrical pickups 208, as shown in FIG. 26. However, when the battery is inserted incorrectly such that the negative terminal 212 is disposed adjacent the prongs 206, the prongs separate the negative terminal 212 from the electrical pickup 206. The gap 209 between the prongs is between about 5 mm and about 14 mm and the prongs have a height 216 which is between about 2 mm and about 14 mm, as best seen in FIG. 28. Thus, when the batteries are properly inserted in the first position as show in FIG. 26, the contact surface of the positive terminal 210 is substantially planar with the contact surface of the negative terminal 212, but when the batteries are improperly inserted in the second position shown in FIG. 27, the contact surface of the positive terminal 210 is disposed below the contact surface of the negative terminal 212 such that both a positive battery terminal and a negative battery terminal do not cooperatively contact the electrical pickups 208.

The foregoing description of the preferred embodiments of the invention have been presented for purposes of illustration and description. It is not intended to be exhaustive or to limit the invention to the precise form disclosed. Modifications or variations are possible and contemplated in light of the above teachings by those skilled in the art, and the embodiments discussed were chosen and described in order to best illustrate the principles of the invention and its practical application. It is intended that the scope of the invention be defined by the claims appended hereto.

What is claimed is:

1. A cleaning implement, comprising:

a liquid delivery system for providing a cleaning liquid to a surface to be cleaned having an electrical motor and a voltage source;

a handle having a switch disposed thereon and comprising a plurality of handle sections, wherein each section has at least one electrical connector which is electrically connected with an electrical connector of an adjacent handle section so that said switch can activate said electrical motor; and a support head pivotally attached to said handle for releasably receiving a cleaning sheet.

2. The cleaning implement of claim 1, wherein said sections are formed from hollow tubes.

3. The cleaning implement of claim 2, wherein said handle comprises a first section, a second section, and a third section, wherein said second section is disposed between said first section and said third section, wherein said second section has two electrical connectors disposed within said tube of said second section and wherein said internal electrical connectors are interconnected by at least one wire within said tube of said second section.

4. The cleaning implement of claim 3, wherein said tubes have a substantially flat surface thereon.

5. The cleaning implement of claim 4, wherein said tubes of said first and third sections of said handle have an outside diameter which is slightly less than the inside diameter of said tube of said second section of said handle so that said first and said third sections of said handle slide into said tube of said second section.

6. The cleaning implement of claim 5, wherein said first and third sections each have a first connector offset from the end of said tube of said first and said third sections and said second section has a second connector disposed adjacent to each end of said tube thereof and wherein said first and second connectors engage to secure said sections together.

7. The cleaning implement of claim 6, wherein said first connectors have at least one prong and said second connectors have at least one hole which engages said at least one hole of said first connectors.

8. The cleaning implement of claim 3, wherein said first section has a handle grip with a handle portion for gripping by a user and a switch portion containing said switch wherein a ridge is disposed between said handle portion and said switch portion for separating said portions.

9. The cleaning implement of claim 8, wherein the longitudinal axis of said switch portion is substantially coaxial with the longitudinal axis of said second section.

10. The cleaning implement of claim 9, wherein the longitudinal axis of said handle portion for gripping is angled relative to the longitudinal axis of said switch portion and wherein said angle is between about 90 degrees and about 140 degrees.

11. The cleaning implement of claim 10, wherein said switch is located below the outer surface of said switch portion.

12. The cleaning implement of claim 3, wherein said first and third sections of said handle each have an electrical connector disposed at the end of each said tube of said first and said third sections.

13. The cleaning implement of claim 3, wherein at least one of said two electrical connectors of said second section of said handle is offset the end of said tube of said second section.

14. The cleaning implement of claim 3, wherein said at least one of said two electrical connectors of said second section is disposed at least about 15 mm from the end of said second section.

15. The cleaning implement of claim 1, wherein said electrical connectors each have a plug and a socket, wherein said plug of one of said electrical connectors engages said socket of another of said electrical connectors.

16. The cleaning implement of claim 15, wherein said plug comprises a cylindrical post having a plurality of ribs extending radially there from.

17. The cleaning implement of claim 16, wherein said socket is in the form of a hole.

* * * * *